US008162498B2

(12) United States Patent
Ramer et al.

(10) Patent No.: US 8,162,498 B2
(45) Date of Patent: Apr. 24, 2012

(54) SOLID STATE LIGHTING USING NANOPHOSPHOR BEARING MATERIAL THAT IS COLOR-NEUTRAL WHEN NOT EXCITED BY A SOLID STATE SOURCE

(75) Inventors: David P. Ramer, Reston, VA (US); Jack C. Rains, Jr., Herndon, VA (US)

(73) Assignee: ABL IP Holding LLC, Conyers, GA (US)

( * ) Notice: Subject to any disclaimer, the term of this patent is extended or adjusted under 35 U.S.C. 154(b) by 0 days.

(21) Appl. No.: 12/729,887

(22) Filed: Mar. 23, 2010

(65) Prior Publication Data

US 2010/0172122 A1 Jul. 8, 2010

Related U.S. Application Data

(63) Continuation-in-part of application No. 12/127,339, filed on May 27, 2008, now Pat. No. 8,021,008, and a continuation-in-part of application No. 12/609,523, filed on Oct. 30, 2009, which is a continuation-in-part of application No. 12/434,248, filed on May 1, 2009, said application No. 12/729,887 is a continuation-in-part of application No. 12/629,614, filed on Dec. 2, 2009, now Pat. No. 7,845,825, and a continuation-in-part of application No. 12/697,596, filed on Feb. 1, 2010, and a continuation-in-part of application No. 12/704,355, filed on Feb. 11, 2010.

(51) Int. Cl.

| | |
|---|---|
| ***F21V 9/16*** | (2006.01) |
| ***F21V 9/12*** | (2006.01) |
| ***H01J 1/63*** | (2006.01) |

(52) U.S. Cl. ..... 362/84; 362/293; 362/311.02; 362/318; 362/231

(58) Field of Classification Search ..... 362/84, 362/85, 98, 501–512, 293, 311.02, 318, 231, 362/240, 241, 249.02

See application file for complete search history.

(56) References Cited

U.S. PATENT DOCUMENTS

| | | | |
|---|---|---|---|
| 4,675,575 | A | 6/1987 | Smith et al. |
| 5,136,483 | A | 8/1992 | Schoniger et al. |

(Continued)

FOREIGN PATENT DOCUMENTS

| | | | |
|---|---|---|---|
| EP | 2 144 275 | A2 | 1/2010 |

(Continued)

OTHER PUBLICATIONS

United States Office Action issued in U.S. Appl. No. 12/127,339, mailed Oct. 28, 2010.

(Continued)

*Primary Examiner* — Ismael Negron

(74) *Attorney, Agent, or Firm* — McDermott Will & Emery LLP

(57) ABSTRACT

A solid state lighting device, such as a lamp or light fixture, includes a solid state source and one or more semiconductor nanophosphors dispersed in a light transmissive material in the element. The material is of a type and the nanophosphor(s) are dispersed therein in such a manner that the material bearing the semiconductor nanophosphor(s) is at least substantially color-neutral to the human observer, when the solid state lighting device is off. In some examples, the material appears relatively clear or transparent when the device is off. In other examples, the material appears translucent, e.g. white, when the device is off.

20 Claims, 7 Drawing Sheets

U.S. PATENT DOCUMENTS 5,285,356 A 2/1994 Skene et al.
5,608,213 A 3/1997 Pinkus et al.
5,803,592 A 9/1998 Lawson
5,877,490 A 3/1999 Ramer et al.
5,914,487 A 6/1999 Ramer et al.
6,007,225 A 12/1999 Ramer et al.
6,045,238 A 4/2000 Wheeler et al.
6,068,383 A * 5/2000 Robertson et al. ..... 362/84
6,222,623 B1 4/2001 Wetherell
6,234,648 B1 5/2001 Borner et al.
6,280,054 B1 8/2001 Cassarly et al.
6,286,979 B1 9/2001 Ramer et al.
6,357,889 B1 3/2002 Duggal et al.
6,361,192 B1 3/2002 Fussell et al.
6,422,718 B1 7/2002 Anderson et al.
6,437,861 B1 8/2002 Kuta
6,447,698 B1 9/2002 Ihara et al.
6,472,765 B1 * 10/2002 Sano et al. ..... 257/787
6,473,554 B1 10/2002 Pelka et al.
6,521,915 B2 * 2/2003 Odaki et al. ..... 257/98
6,533,429 B2 3/2003 Yoneda
6,536,914 B2 3/2003 Hoelen et al.
6,566,824 B2 5/2003 Panagotacos et al.
6,672,741 B1 1/2004 Young
6,682,211 B2 1/2004 English et al.
6,692,136 B2 2/2004 Marshall et al.
6,700,112 B2 3/2004 Brown
6,734,465 B1 5/2004 Taskar et al.
6,737,681 B2 5/2004 Koda
6,744,960 B2 6/2004 Pelka
6,836,083 B2 12/2004 Mukai
6,869,545 B2 3/2005 Peng et al.
6,872,249 B2 3/2005 Peng et al.
6,936,855 B1 8/2005 Harrah
6,960,872 B2 11/2005 Beeson et al.
6,969,843 B1 11/2005 Beach et al.
6,985,163 B2 1/2006 Riddle et al.
6,988,815 B1 1/2006 Rizkin et al.
6,992,317 B2 1/2006 Jain et al.
6,995,355 B2 2/2006 Rains, Jr. et al.
7,025,464 B2 4/2006 Beeson et al.
7,029,935 B2 4/2006 Negley et al.
7,040,774 B2 5/2006 Beeson et al.
7,102,152 B2 9/2006 Chua et al.
7,105,051 B2 9/2006 Peng et al.
7,122,961 B1 10/2006 Wedding
7,144,131 B2 12/2006 Rains
7,148,632 B2 12/2006 Berman et al.
7,153,703 B2 12/2006 Peng et al.
7,160,525 B1 1/2007 Peng et al.
7,192,850 B2 3/2007 Chen et al.
7,193,248 B2 3/2007 Weindorf et al.
7,220,039 B2 5/2007 Ahn et al.
7,235,190 B1 6/2007 Wilcoxon et al.
7,235,792 B2 6/2007 Elofson
7,237,927 B2 7/2007 Coushaine et al.
7,259,400 B1 8/2007 Taskar et al.
7,261,452 B2 8/2007 Coushaine et al.
7,273,904 B2 9/2007 Peng et al.
7,350,933 B2 4/2008 Ng et al.
7,374,807 B2 5/2008 Parce et al.
7,443,678 B2 10/2008 Han et al.
7,473,022 B2 1/2009 Yoo
7,510,299 B2 3/2009 Timmermans et al.
7,531,149 B2 5/2009 Peng et al.
7,560,677 B2 7/2009 Lyons et al.
7,600,882 B1 10/2009 Morejon et al.
7,695,164 B2 4/2010 Berben et al.
7,712,918 B2 5/2010 Siemiet et al.
7,768,192 B2 8/2010 Van De Ven et al.
7,806,556 B2 10/2010 Wu
7,845,825 B2 12/2010 Ramer et al.
7,891,840 B1 2/2011 Kang et al.
2003/0016536 A1 1/2003 Lin
2003/0034985 A1 2/2003 Needham Riddle et al.
2004/0135504 A1 7/2004 Tamaki et al.
2004/0151008 A1 8/2004 Artsyukhovich et al.
2004/0188594 A1 9/2004 Brown et al.
2004/0201990 A1 10/2004 Meyer
2004/0201995 A1 10/2004 Galli
2004/0233664 A1 11/2004 Beeson et al.
2005/0230673 A1 10/2005 Mueller et al.
2005/0243558 A1 11/2005 Van Duyn
2006/0072314 A1 4/2006 Rains
2006/0158857 A1 7/2006 Luckner et al.
2006/0170335 A1 8/2006 Cho et al.
2006/0289884 A1 12/2006 Soules et al.
2006/0291226 A1 12/2006 Daicho et al.
2007/0018558 A1 1/2007 Chua et al.
2007/0024173 A1 2/2007 Braune
2007/0045524 A1 3/2007 Rains, Jr. et al.
2007/0051883 A1 3/2007 Rains, Jr. et al.
2007/0091639 A1 4/2007 Yoo
2007/0096118 A1 5/2007 Mahalingam et al.
2007/0138978 A1 6/2007 Rains, Jr. et al.
2007/0139961 A1 6/2007 Cheah et al.
2007/0153518 A1 7/2007 Chen
2007/0170454 A1 7/2007 Andrews
2007/0183152 A1 8/2007 Hauck et al.
2007/0228999 A1 10/2007 Kit
2007/0242441 A1 10/2007 Aldrich et al.
2007/0263393 A1 11/2007 Van De Ven
2008/0024067 A1 1/2008 Ishibashi
2008/0030974 A1 2/2008 Abu-Ageel
2008/0043480 A1 2/2008 Kong
2008/0084706 A1 4/2008 Roshan et al.
2008/0094835 A1 4/2008 Marra et al.
2008/0106887 A1 5/2008 Salsbury et al.
2008/0224025 A1 9/2008 Lyons et al.
2008/0291670 A1 11/2008 Rains
2008/0315784 A1 12/2008 Tseng
2009/0003002 A1 1/2009 Sato
2009/0034292 A1 2/2009 Pokrovskiy et al.
2009/0162011 A1 6/2009 Coe-Sullivan et al.
2009/0195186 A1 8/2009 Guest et al.
2009/0251884 A1 10/2009 Rains
2009/0268461 A1 10/2009 Deak et al.
2009/0295266 A1 12/2009 Ramer et al.
2009/0296368 A1 12/2009 Ramer
2009/0302730 A1 12/2009 Carroll et al.
2010/0002414 A1 1/2010 Meir et al.
2010/0002453 A1 1/2010 Wu et al.
2010/0053970 A1 3/2010 Sato et al.
2010/0053977 A1 3/2010 Chen
2010/0091491 A1 * 4/2010 Jiang et al. ..... 362/235
2010/0123155 A1 5/2010 Pickett et al.
2010/0124058 A1 5/2010 Miller et al.
2010/0172122 A1 7/2010 Ramer et al.
2010/0277059 A1 11/2010 Rains, Jr. et al.
2010/0277904 A1 11/2010 Hanley et al.
2010/0277907 A1 11/2010 Phipps et al.
2011/0095686 A1 4/2011 Falicoff et al.
2011/0175528 A1 7/2011 Rains, Jr. et al.

FOREIGN PATENT DOCUMENTS

WO WO 2008/052318 A1 5/2008
WO WO 2008/134056 A1 11/2008
WO WO 2008/155295 A1 12/2008
WO WO 2009/137053 A1 11/2009

OTHER PUBLICATIONS

International Preliminary Report on Patentability and Written Opinion of the International Searching Authority, issued in International Patent Application No. PCT/US2009/044025, mailed Jul. 1, 2009.
United States Notice of Allowance issued in U.S. Appl. No. 12/434,248 dated Jul. 26, 2011.
Entire prosecution history of U.S. Appl. No. 12/127,339, filed May 27, 2008 entitled Solid State Lighting Using Quantum Dots in a Liquid.
Entire prosecution history of U.S. Appl. No. 12/609,523, filed Oct. 30, 2009 entitled Heat Sinking and Flexible Circuit Board, for Solid State Light Fixture Utilizing an Optical Cavity.
Entire prosecution history of U.S. Appl. No. 12/434,248, filed May 1, 2009 entitled Heat Sinking and Flexible Circuit Board, for Solid State Light Fixture Utilizing an Optical Cavity.

Entire prosecution history of U.S. Appl. No. 12/629,614, filed Dec. 2, 2009 entitled Light Fixture Using Near UV Solid State Device and Remote Semiconductor Nanophosphors to Produce White Light.
Entire prosecution history of U.S. Appl. No. 12/697,596, filed Feb. 1, 2010 entitled Lamp Using Solid State Source and Doped Semiconductor Nanophosphor.
Entire prosecution history of U.S. Appl. No. 12/704,355, filed Feb. 11, 2010 entitled Light Fixture Using Doped Semiconductor Nanophosphor in a Gas.
United States Office Action issued in U.S. Appl. No. 12/729,788 dated May 11, 2011.
International Search Report and the Written Opinion of the International Searching Authority issued in International Patent Application No. PCT/US2010/028159 dated Jun. 1, 2010.
Pradhan, Narayan, et al., "An Alternative of CdSe Nanocrystal Emitters: Pure and Tunable Impurity Emissions in ZnSe Nonocrystais", Nov. 24, 2005, 127, pp. 17586-17587, J. A, Chem, Soc. Communications, web publication.
"Energy Star Program Requirements for Solid State Lighting Luminaires Eligibility Criteria—Version 1.0", Manuel, Sep. 12, 2007.
Yin, Yadong and A. Paul Alivisatos, "Colloidal nanocrystal sythesis and the organic-inorganic interface", Insight Review, Sep. 25, 2005, pp. 664-670, Nature vol. 437.
"Final Report: Highly Bright, Heavy Metal-Free, and Stable Doped Semiconductor Nanophosphors for Economical Solid State Lighting Alternatives", Report, Nov. 12, 2009, pp. 1-3, National Center for Environmental Research, web publication.
"Solid-State Lighting: Development of White LEDs Using Nanophosphor-InP Blends", Report, Oct. 26, 2009, p. 1, U.S. Department of Energy—Energy Efficiency and Renewable Energy, web publication.
"Solid-State Lighting: Improved Light Extraction Efficiencies of White pc-LEDs for SSL by Using Non-Toxic, Non-Scattering, Bright, and Stable Doped ZnSe Quantum Dot Nanophosphors (Phase I)", Report, Oct. 26, 2009,pp. 1-2, U.S. Department of Energy—Energy Efficiency and Renewable Energy, web publication.
"Chemistry—All in the Dope", Editor's Choice, Dec. 9, 2005, Science, vol. 310, p. 1, AAAS, web publication.
"D-dots: Heavy Metal Free Doped Semiconductor Nanocrystais", Technical Specifications, etc. Dec. 1, 2009, pp. 1-2, NN-LABS, LLC (Nanomaterials & Nanofabrication Laboratories), CdSe/ZnS Semiconductor Nanocrystals, web publication.
U.S. Appl. No. 12/629,614, filed Dec. 2, 2009 with Official Filing Receipt and New Utility Transmittal.
LED *Lumen-Starr* Lamp Tubes; LED LS-1007; DM Technology & Energy, INC.
United States Office Action issued in U.S. Appl. No. 12/729,887 dated Jun. 21, 2011.
International Search Report and the Written Opinion of the International Searching Authority issued in International Patent Application No. PCT/US2009/044025 dated Jul. 1, 2009.
Notification Concerning Transmittal of International Preliminary Report of Patentability issued in International Application No. PCT/US2009/044025 dated Dec. 9, 2010.
International Search Report and Written Opinion of the International Searching Authority issued in International Patent Application No. PCT/US2010/028285, mailed May 19, 2010.
International Search Report and Written Opinion of the International Searching Authority issued in International Patent Application No. PCT/US2010/028302, mailed May 19, 2010.
International Search Report and Written Opinion of the International Searching Authority issued in International Patent Application No. PCT/US2010/028295, mailed May 21, 2010.
V. Ya. Rudyak et al., "On the Viscosity of Rarefied Gas Suspensions Containing Nanoparticles," Doklady Physics vol. 48 No. 10, 2003, pp. 583-586.
International Search Report and Written Opinion of the International Searching Authority issued in International Patent Application No. PCT/US2010/028247, mailed May 19, 2010.
International Search Report and Written Opinion of the International Searching Authority issued in International Patent Application No. PCT/US2011/027179 dated Jul. 14, 2011.
European Search Report issued in European Patent Application No. EP 09755624.5 dated Apr. 20, 2011.
United States Notice of Allowance issued in U.S. Appl. No. 12/127,339 dated Jul. 13, 2011, now U.S. Patent No. 8,021,008.
United States Office Action issued in U.S. Appl. No. 12/729,788 dated Sep. 13, 2011.
International Preliminary Report on Patentability (Chapter I of the Patent Cooperation Treaty) issued in International Patent Application No. PCT/US2010/028295 dated Nov. 10, 2011.
International Preliminary Report on Patentability (Chapter I of the Patent Cooperation Treaty) issued in International Patent Application No. PCT/US2010/028302 dated Nov. 10, 2011.

* cited by examiner

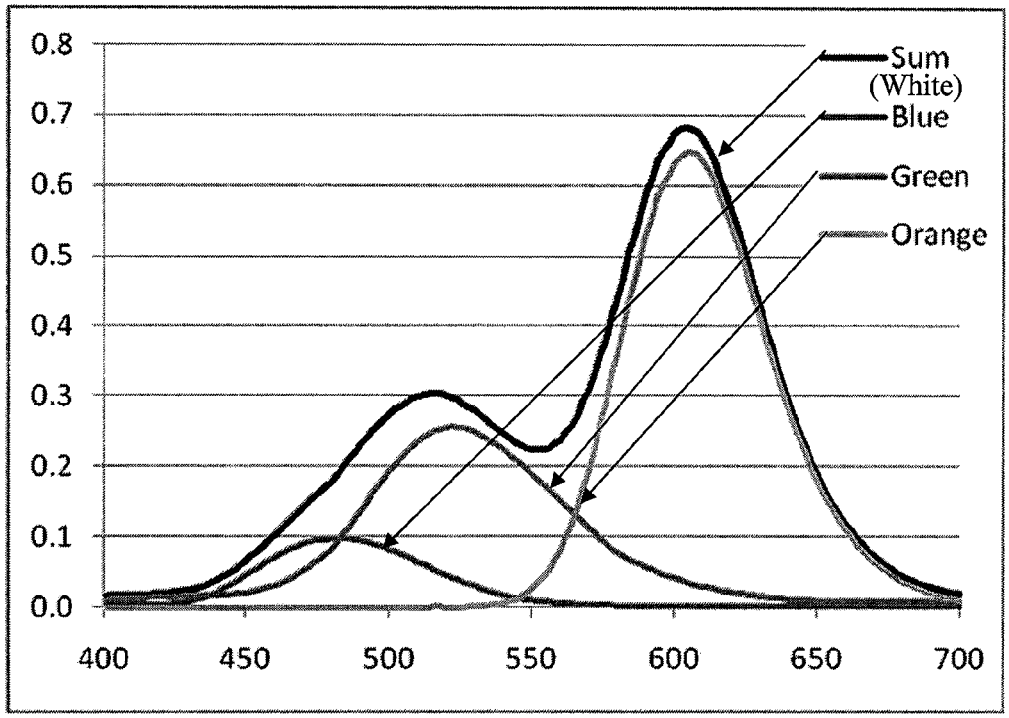
FIG. 5A Wavelength (nm)
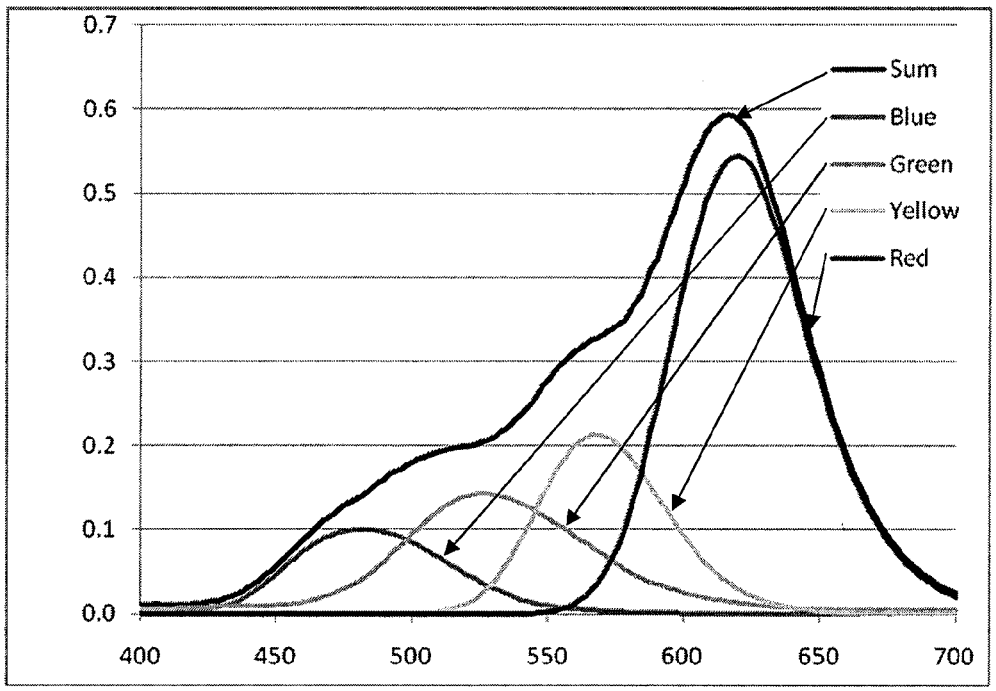
FIG. 5B Wavelength (nm)

SOLID STATE LIGHTING USING NANOPHOSPHOR BEARING MATERIAL THAT IS COLOR-NEUTRAL WHEN NOT EXCITED BY A SOLID STATE SOURCE

RELATED APPLICATIONS

This application is a continuation in part of U.S. application Ser. No. 12/127,339 Filed May 27, 2008, now U.S. Pat. No. 8,021,008, entitled "Solid State Lighting Using Quantum Dots in a Liquid," the disclosure of which is entirely incorporated herein by reference.

This application is also a continuation in part of U.S. application Ser. No. 12/609,523 Filed Oct. 30, 2009 entitled "Heat Sinking and Flexible Circuit Board, for Solid State Light Fixture Utilizing an Optical Cavity," which is a continuation in part of U.S. application Ser. No. 12/434,248 Filed May 1, 2009 entitled "Heat Sinking and Flexible Circuit Board, for Solid State Light Fixture Utilizing an Optical Cavity," the disclosures of which are entirely incorporated herein by reference.

This application is also a continuation in part of U.S. application Ser. No. 12/629,614 Filed Dec. 2, 2009, now U.S. Pat. No. 7,845,825, entitled "Light Fixture Using Near UV Solid State Device and Remote Semiconductor Nanophosphors to Produce White Light," the disclosure of which also is entirely incorporated herein by reference.

This application is also a continuation in part of U.S. application Ser. No. 12/697,596 Filed Feb. 1, 2010 entitled "Lamp Using Solid State Source and Doped Semiconductor Nanophosphor," the disclosure of which also is entirely incorporated herein by reference.

This application is also a continuation in part of U.S. application Ser. No. 12/704,355 Filed Feb. 11, 2010 entitled "Light Fixture Using Doped Semiconductor Nanophosphor in a Gas," the disclosure of which also is entirely incorporated herein by reference.

TECHNICAL FIELD

The present subject matter relates to solid state lighting devices and components for such devices, where the devices use one or more semiconductor nanophosphors, such as quantum dots or doped semiconductor nanophosphors, remotely deployed in a transmissive material in the device in such a manner that the material bearing the semiconductor nanophosphor(s) appears at least substantially color-neutral to the human observer, that is to say it causes little or no perceptible tint or color shift, when the solid state lighting device is off.

BACKGROUND

As costs of energy increase along with concerns about global warming due to consumption of fossil fuels to generate energy, there is an every increasing need for more efficient lighting technologies. These demands, coupled with rapid improvements in semiconductors and related manufacturing technologies, are driving a trend in the lighting industry toward the use of light emitting diodes (LEDs) or other solid state light sources to produce light for general lighting applications, as replacements for incandescent lighting and eventually as replacements for other older less efficient light sources.

The actual solid state light sources, however, produce light of specific limited spectral characteristics. To obtain white light of a desired characteristic and/or other desirable light colors, one approach uses sources that produce light of two or more different colors or wavelengths and one or more optical processing elements to combine or mix the light of the various wavelengths to produce the desired characteristic in the output light. In recent years, techniques have also been developed to shift or enhance the characteristics of light generated by solid state sources using phosphors, including for generating white light using LEDs.

Phosphor based techniques for generating white light from LEDs, currently favored by LED manufacturers, include UV or Blue LED pumped phosphors or nanophosphors. The phosphor materials may be provided as part of the LED package (on or in close proximity to the actual semiconductor chip), or the phosphor materials may be provided remotely (e.g. on or in association with a macro optical processing element such as a diffuser or reflector outside the LED package). The remote phosphor based solutions have advantages, for example, in that the color characteristics of the fixture output are more repeatable, whereas solutions using sets of different color LEDs and/or lighting systems with the phosphors inside the LED packages tend to vary somewhat in light output color from fixture to fixture, due to differences in the light output properties of different sets of LEDs (due to lax manufacturing tolerances of the LEDs).

Although these solid state lighting technologies have advanced considerably in recent years, there is still room for further improvement. For example, it is desirable in the lighting industry to provide lighting systems, which when installed, blend in or are neutral with their surrounding environments, such as ceilings, which are typically white in color. An installed lighting system is more visibly pleasing when its overall observed color is white or silver. However, when certain remote phosphor materials are used in lighting systems, they are often visible from outside of the fixture when not in use. Some phosphor materials for example, may have an undesirable salmon or yellowish color.

SUMMARY

Hence a need exists for alternative techniques to effectively include a remote phosphor material in solid state lighting devices such that the remote phosphor is not readily perceptible to a person viewing the device when off, and still allow for the device to produce desired light output when on, e.g. white light of high quality (e.g. desirable color rendering index and/or color temperatures).

To address such needs entails remote deployment of one or more semiconductor nanophosphors in a material, where the material is of a type and the nanophosphor(s) are dispersed therein in such a manner that the material bearing the semiconductor nanophosphor(s) appears at least substantially color-neutral to the human observer when the solid state lighting device is off. Specific implementations of the color-neutral appearance in the off-state include examples that appear at least substantially clear as well as examples in which the material exhibits a somewhat white or translucent appearance. Any surfaces of the fixture that may be visible when the device is off will be subject to little or no perceptible discoloration due to the presence of the remotely deployed phosphor.

The present teachings encompass examples that use such a material bearing one or more nanophosphors in an apparatus such as an optical element, for use in various lighting fixture configurations as well as various configurations of other lighting devices, such as various designs for lamp products.

Other teachings herein relate to examples that use a liquid type material with the phosphor or phosphors dispersed therein. A bubble inside the container with the material is configured to essentially disappear when the transmissive liquid material reaches a nominal operating temperature.

Additional advantages and novel features will be set forth in part in the description which follows, and in part will become apparent to those skilled in the art upon examination of the following and the accompanying drawings or may be learned by production or operation of the examples. The advantages of the present teachings may be realized and attained by practice or use of various aspects of the methodologies, instrumentalities and combinations set forth in the detailed examples discussed below.

BRIEF DESCRIPTION OF THE DRAWINGS

The drawing figures depict one or more implementations in accord with the present teachings, by way of example only, not by way of limitation. In the figures, like reference numerals refer to the same or similar elements.

FIG. 5A is a graph of emission spectra of three of the doped semiconductor nanophosphors selected for use in an exemplary solid state light emitting device as well as the spectrum of the white light produced by combining the spectral emissions from those three phosphors.

FIG. 5B is a graph of emission spectra of four doped semiconductor nanophosphors, in this case, for red, green, blue and yellow emissions, as the spectrum of the white light produced by combining the spectral emissions from those four phosphors.

DETAILED DESCRIPTION

Figure 1:
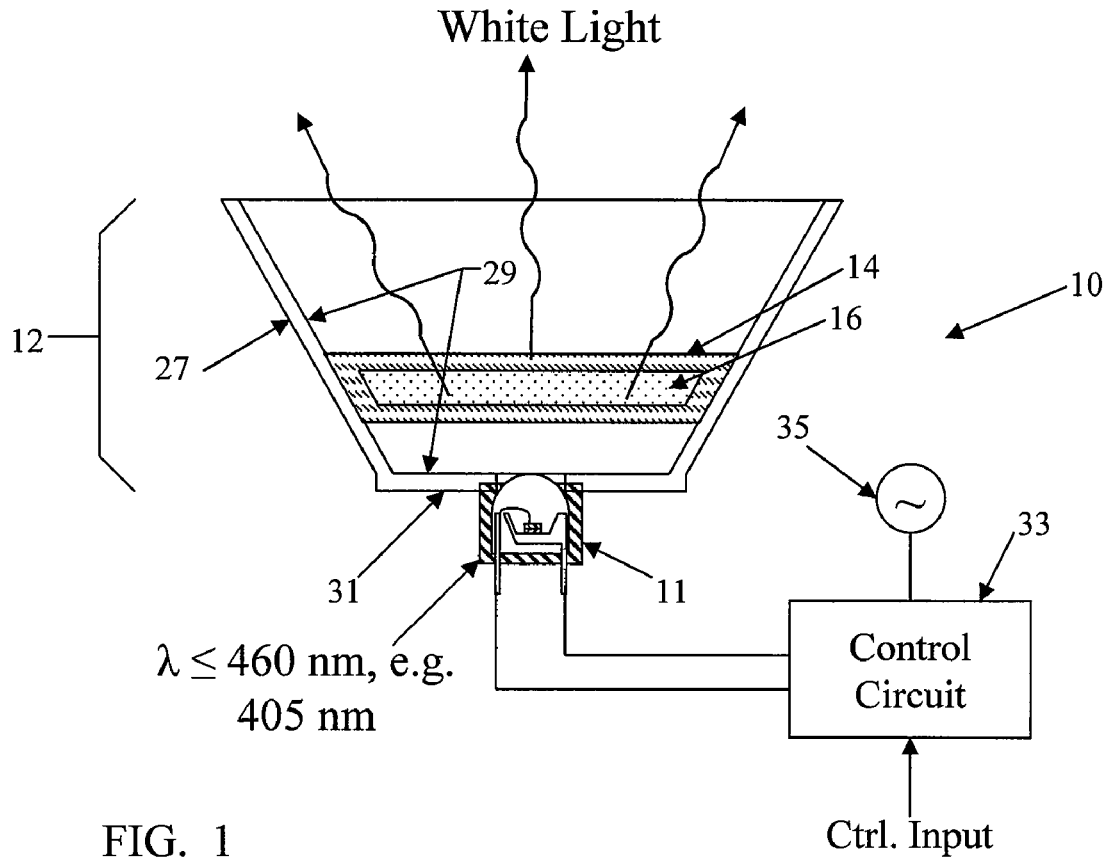
FIG. 1 illustrates an example of a light emitting system, with certain elements thereof shown in cross-section.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

Various apparatuses are described below, for producing visible light in response to electromagnetic energy from a solid state source. Such an apparatus may take the form of an optical processing element for use in a solid state lighting device. Examples of such devices include light fixtures and lamps. The drawings and description also encompass systems incorporating the fixture or lamp. The exemplary optical processing elements enable remote deployment of the semiconductor nanophosphor. One or more such nanophosphors are dispersed in a material in the apparatus, where the material is of a type and the nanophosphor(s) are dispersed therein in such a manner that the material bearing the semiconductor nanophosphor(s) appears at least substantially color-neutral to the human observer when the solid state source of the lighting device is off. In this way, the remotely deployed nanophosphor is not readily perceptible to a person viewing the lighting device when off. Clear and translucent off-state appearances are discussed, by way of examples.

Before discussing structural examples, it may be helpful to discuss the types of phosphors of interest here. Semiconductor nanophosphors are nanoscale crystals or "nanocrystals" formed of semiconductor materials, which exhibit phosphorescent light emission in response to excitation by electromagnetic energy of an appropriate input spectrum (excitation or absorption spectrum). Examples of such nanophosphors include quantum dots (q-dots) formed of semiconductor materials. Like other phosphors, quantum dots and other semiconductor nanophosphors absorb light of one wavelength band or spectrum and re-emit light at a different band of wavelengths or different spectrum. However, unlike conventional phosphors, optical properties of the semiconductor nanophosphors can be more easily tailored, for example, as a function of the size of the nanocrystals. In this way, for example, it is possible to adjust the absorption spectrum and/or the emission spectrum of the semiconductor nanophosphors by controlling crystal formation during the manufacturing process so as to change the size of the nanocrystals. For example, nanocrystals of the same material, but with different sizes, can absorb and/or emit light of different colors. For at least some semiconductor nanophosphor materials, the larger the nanocrystals, the redder the spectrum of re-emitted light; whereas smaller nanocrystals produce a bluer spectrum of re-emitted light.

Doped semiconductor nanophosphors are somewhat similar in that they are nanocrystals formed of semiconductor materials. However, this later type of semiconductor nanophosphors is doped, for example, with a transition metal or a rare earth metal. The doped semiconductor nanophosphors used in some of the exemplary solid state light emitting devices discussed herein are configured to convert energy in a range somewhere in the spectrum at about 460 nm and below into wavelengths of visible light, which produce a desirable characteristic of visible light for the output of the lighting device. A number of specific examples produce high CRI visible white light emission.

Semiconductor nanophosphors, including doped semiconductor nanophosphors, may be grown by a number of techniques. For example, colloidal nanocrystals are solution-grown, although non-colloidal techniques are possible.

For some lighting applications where a single color is desirable rather than white, the lighting device might use a single type of nanophosphor in the material. For a yellow 'bug lamp' type application, for example, the one nanophosphor would be of a type that produces yellow emission in response to pumping energy from the solid state source. For a red light type application, as another example, the one nanophosphor would be of a type that produces predominantly red light emission in response to pumping energy from the solid state source. Many examples, however, will include two, three or more nanophosphors dispersed in the phosphor bearing material, so that the emissions spectra of the nanophosphors may be combined to produce an overall emission spectra in the lighting device output that is desirable for a particular lighting application.

For a high CRI type white light application, a material containing or otherwise including a dispersion of semiconductor nanophosphors, of the type discussed in the examples herein, would contain several different types of semiconductor nanocrystals sized and/or doped so as to be excited by the light energy in the relevant part of the spectrum. In several examples, absorption spectra have upper limits somewhere between 430 and 460 nm (nanometers), and the lighting devices use LEDs rated to emit light in a comparable portion of the spectrum. The different types of nanocrystals (e.g. semiconductor material, crystal size and/or doping properties) in the mixture are selected by their emission spectra, so that together the excited nanophosphors provides the high CRI white light of a rated color temperature when all are excited by the energy from the relevant type of solid state source. Relative proportions in the mixture may also be chosen to help produce the desired output spectrum for a particular lighting application.

Doped semiconductor nanophosphors exhibit a relatively large Stokes shift, from lower wavelength of absorption spectra to higher wavelength emissions spectra. In several specific white light examples, each of the phosphors is of a type excited in response to near UV electromagnetic energy in the range of 380-420 nm and/or UV energy in a range of 380 nm and below. Each type of nanophosphor re-emits visible light of a different spectral characteristic, and each of the phosphor emission spectra has little or no overlap with excitation or absorption ranges of the nanophosphors dispersed in the gas. Because of the magnitudes of the shifts, the emissions are substantially free of any overlap with the absorption spectra of the phosphors, and re-absorption of light emitted by the phosphors can be reduced or eliminated, even in applications that use a mixture of a number of such phosphors to stack the emission spectra thereof so as to provide a desired spectral characteristic in the combined light output.

The nanophosphors, particularly the doped semiconductor nanophosphors, are excited by light in the near UV to blue end of the visible spectrum and/or by UV light energy. However, nanophosphors can be used that are relatively insensitive to other ranges of visible light often found in natural or other ambient white visible light. Hence, when the lighting device is off, the semiconductor nanophosphor will exhibit little or not light emissions that might otherwise be perceived as color by a human observer. The medium or material chosen to bear the nanophosphor is itself at least substantially color-neutral. Although not emitting, the particles of the doped semiconductor nanophosphor may have some color, but due to their small size and dispersion in the material, the overall effect is that the material with the nanophosphors dispersed therein appears at least substantially color-neutral to the human observer, that is to say it has little or no perceptible tint, when there is no excitation energy from the appropriate solid state source.

The material with the dispersed nanophosphors will be sufficiently color-neutral in that it will exhibit little or no perceptible tint. The nanophosphors are chosen to be subject to relatively little excitation from ambient light (in the absence of energy from the solid state source). The material or medium (by itself) is chosen to have optical properties, such as absorptivity or dispersion/scattering properties that are generally independent of wavelengths, at least across the visible portion of the spectrum, so that the product, the combination of the medium with the nanophosphors, is color-neutral.

For example, the material or medium used to bear the nanophosphors may be at least substantially clear or transparent. To optimize performance, the material will have a low absorptivity with respect to the relevant wavelengths, particularly those in the visible portion of the spectrum as emitted by the nanophosphor(s). To avoid any perceptible tint, the absorptivity of the material will also be relatively wavelength independent across at least that visible portion of the spectrum. The overall appearance of the transparent material with the nanophosphor(s) dispersed therein is relatively clear, when the device (and thus the solid state source) is off.

By way of another example, the material or medium used to bear the nanophosphor(s) may be translucent. Such a material would appear diffuse white to an observer. Such a material may be implemented using a transparent medium to which is added a wavelength independent scattering agent. The scattering agent tends to diffusely refract and/or reflect light. Such an agent actually may take the form of clear particles dispersed in the medium. However, due to the diffuse scattering of light from the particles, the effect is that the material (medium plus scattering agent) appears translucent white. The resulting medium is color-neutral in that the refraction and/or reflection produced by the diffuse particles is substantially independent of the light impacting on the scattering agent. The overall appearance of the translucent material with the nanophosphor(s) dispersed therein is relatively white, when the device (and thus the solid state source) is off.

As discussed herein, applicable solid state light emitting elements or sources essentially include any of a wide range of light emitting or generating devices formed from organic or inorganic semiconductor materials. Examples of solid state light emitting elements include semiconductor laser devices and the like. Many common examples of solid state lighting elements, however, are classified as types of "light emitting diodes" or "LEDs." This exemplary class of solid state light emitting devices encompasses any and all types of semiconductor diode devices that are capable of receiving an electrical signal and producing a responsive output of electromagnetic energy. Thus, the term "LED" should be understood to include light emitting diodes of all types, light emitting polymers, organic diodes, and the like. LEDs may be individually packaged, as in the illustrated examples. Of course, LED based devices may be used that include a plurality of LEDs within one package, for example, multi-die LEDs two, three or more LEDs within one package. Those skilled in the art will recognize that "LED" terminology does not restrict the source to any particular type of package for the LED type source. Such terms encompass LED devices that may be packaged or non-packaged, chip on board LEDs, surface mount LEDs, and any other configuration of the semiconductor diode device that emits light. Solid state lighting elements may include one or more phosphors and/or quantum dots, which are integrated into elements of the package or light processing elements of the fixture to convert at least some radiant energy to a different more desirable wavelength or range of wavelengths.

With that introduction, reference now is made in detail to the examples illustrated in the accompanying drawings and discussed below.

FIG. 1 is a simplified illustration of a lighting system 10, for emitting visible light, so as to be perceptible by a person. The system includes a solid state lighting device, which in this first example is a light fixture. A fixture portion of the system 10 is shown in cross-section (although some cross-hatching thereof has been omitted for ease of illustration). The circuit elements are shown in functional block form. The system 10 utilizes a solid state source 11, which, in this example, is rated for emitting electromagnetic energy at a wavelength in the range of 460 nm and below ($\lambda \leqq 460$ nm). Of course, there may be any number of solid state sources 11, as deemed appropriate to produce the desired level of output for the system 10 for any particular intended lighting application.

The examples use one or more LEDs to supply the energy to excite the nanophosphors. The solid state source in such cases may be the collection of the LEDs. Alternatively, each LED may be considered a separate solid state source. Stated another way, a source may include one or more actual emitters.

The solid state source 11 is a semiconductor based structure for emitting electromagnetic energy. An exemplary structure includes a semiconductor chip, such as a light emitting diode (LED), a laser diode or the like, within a package or enclosure. A light transmissive portion of the package that encloses the chip, for example, an element formed of glass or plastic, allows for emission of the electromagnetic energy in the desired direction. Many such source packages include internal reflectors to direct energy in the desired direction and reduce internal losses. To provide readers a full understanding, it may help to consider a simplified example of the structure of such a solid state source 11.

Figure 2:
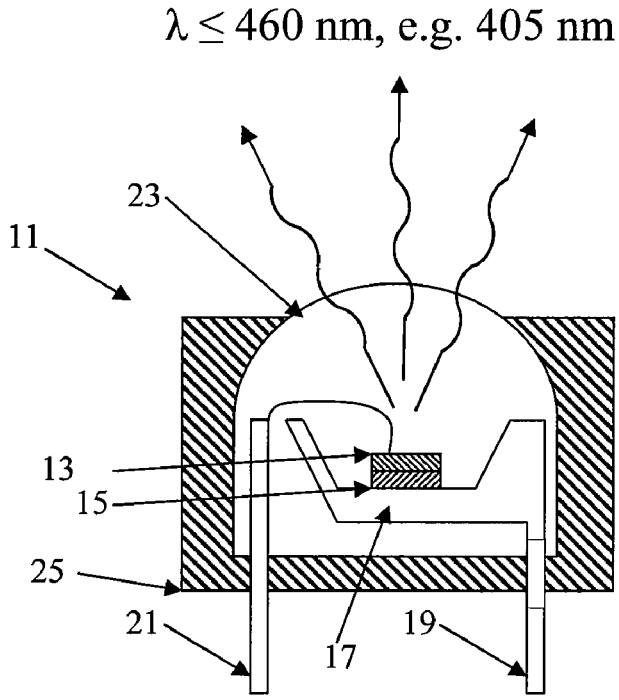
FIG. 2 is a simplified cross-sectional view of a light-emitting diode (LED) type solid state source, which may be used as the source in the system of FIG. 1.

FIG. 2 illustrates a simple example of a LED type solid state source 11, in cross section. In the example of FIG. 2, the source 11 includes at least one semiconductor chip, each comprising two or more semiconductor layers 13, 15 forming the actual LED device. The semiconductor layers 13, 15 of the chip are mounted on an internal reflective cup 17, formed as an extension of a first electrode, e.g. the cathode 19. The cathode 19 and an anode 21 provide electrical connections to layers of the semiconductor chip device within the packaging for the source 11. In the example, an epoxy dome 23 (or similar transmissive part) of the enclosure allows for emission of the electromagnetic energy from the chip in the desired direction.

In this simple example, the solid state source 11 also includes a housing 25 that completes the packaging/enclosure for the source. At least for many modern lighting applications, the housing 25 is metal, e.g. to provide good heat conductivity so as to facilitate dissipation of heat generated during operation of the LED. Internal "micro" reflectors, such as the reflective cup 17, direct energy in the desired direction and reduce internal losses. Although one or more elements in the package, such as the reflector 17 or dome 23 may be doped or coated with phosphor materials, phosphor doping integrated in (on or within) the package is not required for remote semiconductor nanophosphor implementations as discussed herein. The point here at this stage of our discussion is that the solid state source 11 is rated to emit electromagnetic energy of a wavelength in the range of 460 nm and below, such as 405 nm in the illustrated example.

Semiconductor devices such as the solid state source 11 exhibit emission spectra having a relatively narrow peak at a predominant wavelength, although some such devices may have a number of peaks in their emission spectra. Often, manufacturers rate such devices with respect to the intended wavelength $\lambda$ of the predominant peak, although there is some variation or tolerance around the rated value, from device to device. Solid state light source devices such as device 11 for use in the exemplary lighting system 10 will have a predominant wavelength $\lambda$ in the range at or below 460 nm ($\lambda \leqq 460$ nm), for example at 405 nm ($\lambda = 405$ nm) which is in the 380-420 nm near UV range. A LED used as solid state source 11 in the examples of FIGS. 1 and 2 that is rated for a 405 nm output, will have a predominant peak in its emission spectra at or about 405 nm (within the manufacturer's tolerance range of that rated wavelength value). The system 10, however, may use devices that have additional peaks in their emission spectra.

The structural configuration of the solid state source 11 shown in FIG. 2 is presented here by way of example only. Those skilled in the art will appreciate that the system 10 can utilize any solid state light emitting device structure, where the device is configured as a source of electromagnetic energy in the relevant wavelength range, for example, having substantial energy emissions in that range $\lambda \leqq 460$ nm, such as a predominant peak at or about 405 nm. However, as will become apparent from the discussion below, the emission spectrum of the solid state source 11 will be within the absorption spectrum of each of the one or more semiconductor nanophosphors used in the fixture of the particular system 10.

Returning to FIG. 1, the system 10 utilizes a macro scale optic 12 together with the solid state source 11 to form a light fixture type of lighting device. The light fixture could be configured for a general lighting application. Examples of general lighting applications include downlighting, task lighting, "wall wash" lighting, emergency egress lighting, as well as illumination of an object or person in a region or area intended to be occupied by one or more people. A task lighting application, for example, typically requires a minimum of approximately 20 foot-candles (fcd) on the surface or level at which the task is to be performed, e.g. on a desktop or countertop. In a room, where the light fixture is mounted in or hung from the ceiling or wall and oriented as a downlight, for example, the distance to the task surface or level can be 35 inches or more below the output of the light fixture. At that level, the light intensity will still be 20 fcd or higher for task lighting to be effective. Of course, the fixture (11, 12) of FIG. 1 may be used in other applications, such as vehicle headlamps, flashlights, etc.

The macro scale optical processing element or 'optic' 12 in this first example includes a macro (outside the packaging of source 11) scale reflector 27. The reflector 27 has a reflective surface 29 arranged to receive at least some electromagnetic energy from the solid state source 11 and/or a remote semiconductor nanophosphor material 16. The disclosed system 10 may use a variety of different structures or arrangements for the reflector 27. For efficiency, the reflective surface 29 of the reflector 27 should be highly reflective. The reflective surface 29 may be specular, semi or quasi specular, or diffusely reflective.

In the example, the emitting region of the solid state source 11 fits into or extends through an aperture in a proximal section 31 of the reflector 27. The solid state source 11 may be coupled to the reflector 27 in any manner that is convenient and/or facilitates a particular lighting application of the system 10. For example, the source 11 may be within the volume of the reflector 27, the source may be outside of the reflector (e.g. above the reflector in the illustrated orientation) and facing to emit electromagnetic energy into the interior of the reflector, or the electromagnetic energy may be coupled from the solid source 11 to the reflector 27 via a light guide or pipe or by an optical fiber. However, close efficient coupling is preferable.

The macro optic 12 will include or have associated therewith an apparatus for producing visible light in response to electromagnetic energy from a solid state source. The apparatus includes a transparent material 16 and one or more semiconductor nanophosphors dispersed in the transparent material. The apparatus could take the form of a coating on a surface within the optic 12, for example on some or all of the surface(s) 29 of the reflector 27, if the material 16 provided sufficient rigidity (e.g. took the form of a relatively solid material). In the example of FIG. 1, the apparatus is in the form of an optical processing element comprising a container 14 for the phosphor bearing material 16.

Hence, the macro optic 12 includes a container 14 formed of an optically transmissive material, at least in a portion thereof where pumping energy will enter the container and a portion thereof where light will emerge from the container as light output for the system fixture. In the example, a transparent input portion of the container receives electromagnetic energy from the solid state source 11 for excitation of the one or more semiconductor nanophosphors dispersed in the transparent material 16 in the container 14. In the arrangement of FIG. 1, the input portion would be the lower surface of the container 14. The output portion is transmissive at least with respect to visible light, for emission of the visible light produced by the excitation of the one or more semiconductor nanophosphors dispersed in the transparent material in the container. The entire outer portion of the container 14 (including the input portion) may also serve as the output portion. In the example, the main output portion would be the upper surface of the container 14. However, outputs through other regions of the apparatus 14 reflect off of surface(s) 29 of reflector 27 for inclusion in the output of the lighting device 12, although such reflected light may pass back through the optical element. The output portion may be transparent or translucent, e.g. transmissive white. Hence, in the example of FIG. 1, the upper surface of the container 14 could be clear or transparent, or that portion of the container could be white.

The container 14 contains or encapsulates a transmissive material bearing the nanophosphor(s), as shown in the drawing at 16, which at least substantially fills the interior volume of the container. For example, if a liquid is used, there may be some gas in the container as well, although the gas should not include oxygen as oxygen tends to degrade the nanophosphors. In this example, the optical processing element formed by container 14 includes at least one doped semiconductor nanophosphor dispersed in the material 16 in the container.

The transmissive material preferably exhibits high transmissivity and/or low absorption to light of the relevant wavelengths. The material may be a solid, although liquid or gaseous materials may help to improve the florescent emissions by the nanophosphors in the material. For example, alcohol, oils (synthetic, vegetable, silicon or other oils) or other liquid media may be used. A silicone material, however, may be cured to form a hardened material, at least along the exterior (to possibly serve as an integral container), or to form a solid throughout the internal volume of the container 14. If hardened silicon is used, however, a glass container still may be used to provide an oxygen barrier to reduce nanophosphor degradation due to exposure to oxygen.

In an example where the bearer material for the phosphor (s) is liquid, a bubble 16" (FIG. 6) may be created when the container is filled. If present, the bubble 16" may be either a gas-filled bubble or a vacuum-vapor bubble.

If the bubble contains a deliberately provided gas, that gas should not contain oxygen or any other element that might interact with the nanophosphor. Nitrogen would be one appropriate example of a gas that may be used.

If the bubble is a vacuum-vapor bubble, the bubble is formed by drawing a vacuum, for example, due to the properties of the suspension or environmental reasons. If a gas is not deliberately provide, vapors from the liquid will almost certainly be present within the vacuum, whenever conditions would create some vacuum pressure within the container. For example, the vacuum-vapor bubble might form due to a vacuum caused by a differential between a volume of the liquid that is less than the volume of the interior of the container. This might occur for example due to a low temperature of the liquid, for example, if the liquid is placed in the container while hot and allowed to cool or if the liquid is of such an amount as to precisely fill the container at a designated operating temperature but the actual temperature is below the operating temperature. Any vapor present would be caused by conversion of the liquid to a gas under the reduced pressure.

In either case, the gas bubble or the vacuum-vapor bubble can be sized to essentially disappear when the suspension material reaches its nominal operating temperature, with sizing such that the maximum operating pressure is not exceeded at maximum operating temperature. If it is a gas-filled bubble, it will get smaller, but will probably not completely disappear with increased temperature. The preferred embodiment is a vacuum-vapor bubble, which may disappear completely at appropriate temperatures.

If a gas is used, the gaseous material, for example, may be hydrogen gas, any of the inert gases, and possibly some hydrocarbon based gases. Combinations of one or more such types of gases might be used.

Hence, although the material in the container may be a solid, further discussion of the examples will assume use of a liquid or gaseous material.

The material is transmissive and has one or more properties that are wavelength independent. A clear material used to bear the nanophosphors would have a low absorptivity with little or no variation relative to wavelengths, at least over most if not all of the visible portion of the spectrum. If the material is translucent, its scattering effect due to refraction and/or reflection will have little or no variation as a function of wavelength over at least a substantial portion of the visible light spectrum.

For further discussion of this first fixture example, we will assume that the entire container is optically transmissive. The material forming the walls of the container 14 also may exhibit high transmissivity and/or low absorption to light of the relevant wavelengths. The walls of the container 14 may be smooth and highly transparent or translucent, and/or one or more surfaces may have an etched or roughened texture. Of course, some portions may be reflective, e.g. along the sidewalls in the illustrated example.

As outlined above, the one or more semiconductor nanophosphors dispersed in the material shown at 16 are of types or configurations (e.g. selected types of doped semiconductor nanophosphors) excitable by the relevant spectrum of energy from the solid state source 11. In the illustrated example, the nanophosphor(s) may have absorption spectra that include some or all of the near UV range, in particular the 405 nm emission spectrum of the exemplary LED source 11. Stated another way, the absorption spectrum of each nanophosphor encompasses at least a substantial portion and sometimes all of the emission spectrum of the LED type solid state source. When excited by electromagnetic energy in its absorption spectrum from the solid state source, each semiconductor nanophosphor emits visible light in a characteristic emission spectrum that is separated from the absorption spectrum of the nanophosphor, for inclusion in a light output for the fixture.

The upper limits of the absorption spectra of the exemplary nanophosphors are all at or below 460 nm, for example, around 430 nm. However, the exemplary nanophosphors are relatively insensitive to other ranges of visible light often found in natural or other ambient white visible light. Hence, when the lighting system 10 is off, the solid state source 11 is off, and the semiconductor nanophosphor(s) in the transmissive material 16 will exhibit little or not light emissions that might otherwise be perceived as color by a human observer. Even though not emitting, the particles of the doped semiconductor nanophosphor may have some color, but due to their small size and dispersion in the material, the overall effect is that the nanophosphor bearing material 16 appears at least substantially color-neutral (e.g. clear or translucent) to the human observer, that is to say it has little or no perceptible tint. As noted earlier, the material may appear at least substantially either clear or translucent when the nanophosphors are not excited.

As noted, one or two of the nanophosphors may be used in the material at 16 to produce a relatively mono-chromatic light output or a light output that appears somewhat less than full white to a person. However, in many commercial examples for general lighting or the like, the fixture produces white light of desirable characteristics using a number of semiconductor nanophosphors, and further discussion of the examples including that of FIG. 1 will concentrate on such white light implementations.

Hence for further discussion of this example, we will assume that the container 14 is filled with a gaseous or liquid material 16 bearing a number of different semiconductor nanophosphors dispersed therein. Also, for further discussion, we will assume that the solid state source 11 is a near UV emitting LED, such as a 405 nm LED or other type of LED rated to emit somewhere in the wavelength range of 380-420 nm. Although other types of semiconductor nanophosphors are contemplated, we will also assume that each nanophosphor is a doped semiconductor of a type excited in response to at least the near UV electromagnetic energy from the LED or LEDs 11 forming the solid state source.

When so excited, each doped semiconductor nanophosphor in the white light fixture re-emits visible light of a different spectrum. However, each such emission spectrum has substantially no overlap with absorption spectra of the doped semiconductor nanophosphors. When excited by the electromagnetic energy received from the LEDs 11, the doped semiconductor nanophosphors together produce visible light output for the light fixture of a desired characteristic, through the exterior surface(s) of the container and the output end of the reflector 27.

In a white light type example of the system 10, the excited nanophosphors together produce output light that is at least substantially white and has a color rendering index (CRI) of 75 or higher. The fixture output light produced by this excitation of the semiconductor nanophosphors exhibits color temperature in one of several desired ranges along the black body curve. Different light fixtures designed for different color temperatures of white output light would use different formulations of mixtures of doped semiconductor nanophosphors. The white output light of the system 10 exhibits color temperature in one of four specific ranges along the black body curve listed in Table 1 below.

TABLE 1

Nominal Color Temperatures and Corresponding Color Temperature Ranges

| Nominal Color Temp. (° Kelvin) | Color Temp. Range (° Kelvin) |
|---|---|
| 2700 | 2725 ± 145 |
| 3000 | 3045 ± 175 |
| 3500 | 3465 ± 245 |
| 4000 | 3985 ± 275 |

Figure 3:
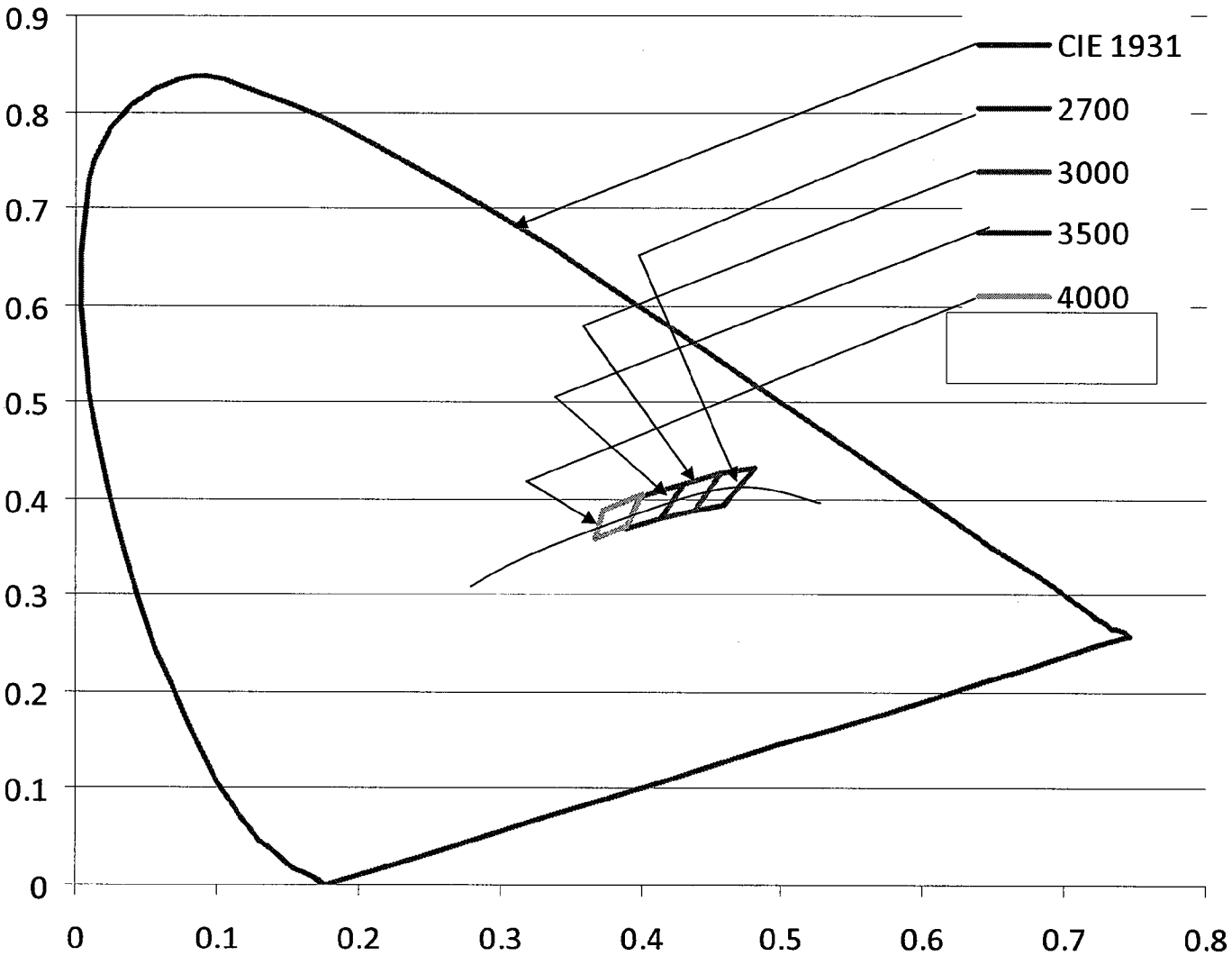
FIG. 3 is a color chart showing the black body curve and tolerance quadrangles along that curve for chromaticities corresponding to several color temperature ranges that are desirable in many general lighting applications.

In Table 1, each nominal color temperature value represents the rated or advertised temperature as would apply to particular lamp products having an output color temperature within the corresponding range. The color temperature ranges fall along the black body curve. FIG. 3 shows the outline of the CIE 1931 color chart, and the curve across a portion of the chart represents a section of the black body curve that includes the desired CIE color temperature (CCT) ranges. The light may also vary somewhat in terms of chromaticity from the coordinates on the black body curve. The quadrangles shown in the drawing represent the respective ranges of chromaticity for the nominal CCT values. Each quadrangle is defined by the range of CCT and the distance from the black body curve. Table 2 below provides chromaticity specifications for the four color temperature ranges. The x, y coordinates define the center points on the black body curve and the vertices of the tolerance quadrangles diagrammatically illustrated in the color chart of FIG. 3.

TABLE 2

Chromaticity Specification for the Four Nominal Values/CCT Ranges

| | CCT Range | | | | | | | |
|---|---|---|---|---|---|---|---|---|
| | 2725 ± 145 | | 3045 ± 175 | | 3465 ± 245 | | 3985 ± 275 | |
| | Nominal CCT | | | | | | | |
| | 2700° K | | 3000° K | | 3500° K | | 4000° K | |
| | x | y | x | y | x | y | x | y |
| Center point | 0.4578 | 0.4101 | 0.4338 | 0.4030 | 0.4073 | 0.3917 | 0.3818 | 0.3797 |
| | 0.4813 | 0.4319 | 0.4562 | 0.4260 | 0.4299 | 0.4165 | 0.4006 | 0.4044 |
| Tolerance | 0.4562 | 0.426 | 0.4299 | 0.4165 | 0.3996 | 0.4015 | 0.3736 | 0.3874 |
| Quadrangle | 0.4373 | 0.3893 | 0.4147 | 0.3814 | 0.3889 | 0.369 | 0.367 | 0.3578 |
| | 0.4593 | 0.3944 | 0.4373 | 0.3893 | 0.4147 | 0.3814 | 0.3898 | 0.3716 |

The solid state lighting system 10 could use a variety of different combinations of semiconductor nanophosphors to produce such an output. Examples of suitable materials are available from NN Labs of Fayetteville, Ark. In a specific example, one or more of the doped semiconductor nanophosphors comprise zinc selenide quantum dots doped with manganese or copper. The selection of one or more such nanophosphors excited mainly by the low end (460 nm or below) of the visible spectrum and/or by UV energy together with dispersion of the nanophosphors in an otherwise color-neutral material, in this example, a clear gas or a clear or translucent liquid, minimizes any potential for discolorization of the fixture when the system 10 is in its off-state that might otherwise be caused by the presence of a phosphor material.

Figure 4A:
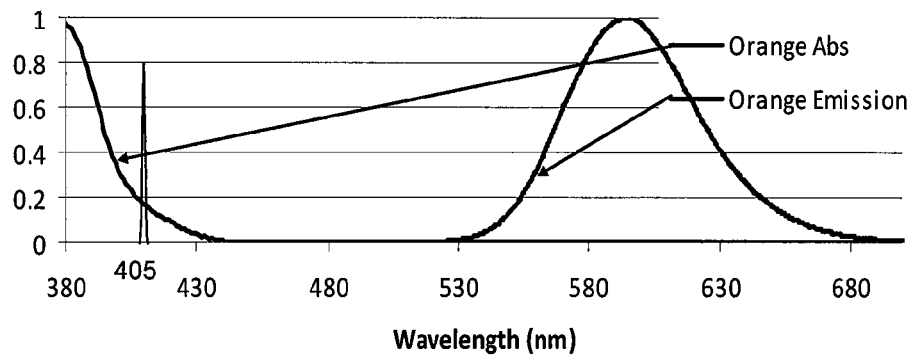
FIGS. 4A-4C are graphs of absorption and emission spectra of a number of doped semiconductor nanophosphors.
Figure 4B:
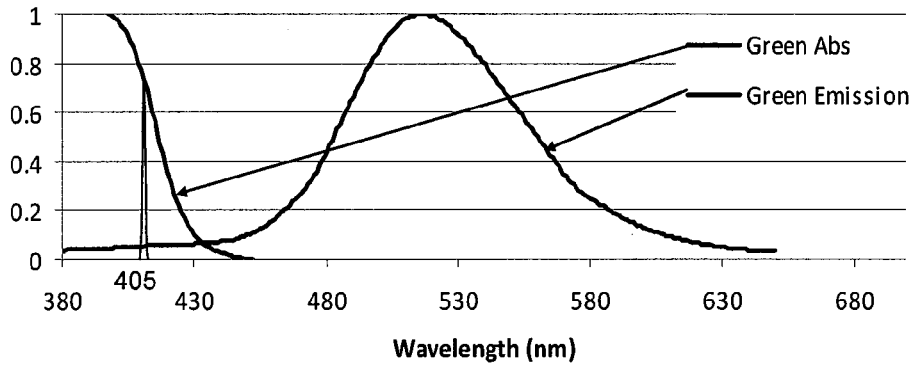
Figure 4C:
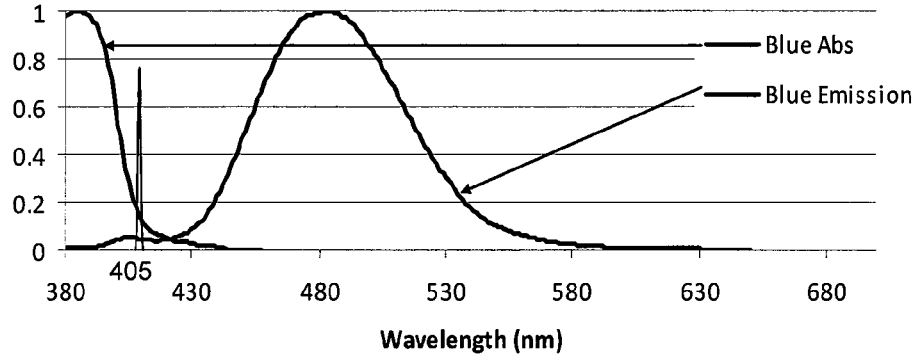

Doped semiconductor nanophosphors exhibit a large Stokes shift, that is to say from a short-wavelength range of absorbed energy up to a fairly well separated longer-wavelength range of emitted light. FIGS. 4A to 4C show the absorption and emission spectra of three examples of doped semiconductor nanophosphors. Each graph also includes an approximation of the emission spectra of the 405 nm LED chip, to help illustrate the relationship of the 405 nm LED emission spectrum to the absorption spectra of the exemplary doped semiconductor nanophosphors. The illustrated spectra are not drawn precisely to scale but in a manner to provide a teaching example to illuminate our discussion here.

The top line (FIG. 4A) of the graph shows the absorption and emission spectra for an orange emitting doped semiconductor nanophosphor. The absorption spectrum for this first phosphor includes the 380-420 nm near UV range, but that absorption spectrum drops substantially to 0 (has an upper limit) somewhere around or a bit below 450 nm. As noted, the phosphor exhibits a large Stokes shift from the short wavelength(s) of absorbed light to the longer wavelengths of re-emitted light. The emission spectrum of this first phosphor has a fairly broad peak in the wavelength region humans perceive as orange. Of note, the emission spectrum of this first phosphor is well above the illustrated absorption spectra of the other doped semiconductor nanophosphors and well above its own absorption spectrum. As a result, orange emissions from the first doped semiconductor nanophosphor would not re-excite that phosphor and would not excite the other doped semiconductor nanophosphors if mixed together. Stated another way, the orange phosphor emissions would be subject to little or no phosphor re-absorption, even in mixtures containing one or more of the other doped semiconductor nanophosphors.

The next line (FIG. 4B) of the graph shows the absorption and emission spectra for a green emitting doped semiconductor nanophosphor. The absorption spectrum for this second phosphor includes the 380-420 nm near UV range, but that absorption spectrum drops substantially to 0 (has an upper limit) about 450 or 460 nm. This phosphor also exhibits a large Stokes shift from the short wavelength(s) of absorbed light to the longer wavelengths of re-emitted light. The emission spectrum of this second phosphor has a broad peak in the wavelength region humans perceive as green. Again, the emission spectrum of the phosphor is well above the illustrated absorption spectra of the other doped semiconductor nanophosphors and well above its own absorption spectrum. As a result, green emissions from the second doped semiconductor nanophosphor would not re-excite that phosphor and would not excite the other doped semiconductor nanophosphors if mixed together. Stated another way, the green phosphor emissions also should be subject to little or no phosphor re-absorption, even in mixtures containing one or more of the other doped semiconductor nanophosphors.

The bottom line (FIG. 4C) of the graph shows the absorption and emission spectra for a blue emitting doped semiconductor nanophosphor. The absorption spectrum for this third phosphor includes the 380-420 nm near UV range, but that absorption spectrum drops substantially to 0 (has an upper limit) about 450 or 460 nm. This phosphor also exhibits a large Stokes shift from the short wavelength(s) of absorbed light to the longer wavelengths of re-emitted light. The emission spectrum of this third phosphor has a broad peak in the wavelength region humans perceive as blue. The main peak of the emission spectrum of the phosphor is well above the illustrated absorption spectra of the other doped semiconductor nanophosphors and well above its own absorption spectrum. In the case of the blue example, there is just a small amount of emissions in the region of the phosphor absorption spectra. As a result, blue emissions from the third doped semiconductor nanophosphor would re-excite that phosphor at most a minimal amount. As in the other phosphor examples of FIGS. 4A and 4B, the blue phosphor emissions would be subject to relatively little phosphor re-absorption, even in mixtures containing one or more of the other doped semiconductor nanophosphors.

Examples of suitable orange, green and blue emitting doped semiconductor nanophosphors of the types generally described above relative to FIGS. 4A to 4C are available from NN Labs of Fayetteville, Ark.

As explained above, the large Stokes shift results in negligible re-absorption of the visible light emitted by doped semiconductor nanophosphors. This allows the stacking of multiple phosphors. It becomes practical to select and mix two, three or more such phosphors in a manner that produces a particular desired spectral characteristic in the combined light output generated by the phosphor emissions.

FIG. 5A graphically depicts emission spectra of three of the doped semiconductor nanophosphors selected for use in an exemplary solid state light fixture as well as the spectrum of the white light produced by summing or combining the spectral emissions from those three phosphors. For convenience, the emission spectrum of the LED has been omitted from FIG. 5A, on the assumption that a high percentage of the 405 nm light from the LED is absorbed by the phosphors. Although the actual output emissions from the fixture may include some near UV light from the LED, the contribution thereof if any to the sum in the output spectrum should be relatively small.

Although other combinations are possible based on the phosphors discussed above relative to FIGS. 4A to 4C or based on other semiconductor nanophosphor materials, the example of FIG. 5A represents emissions of blue, green and orange phosphors. The emission spectra of the blue, green and orange emitting doped semiconductor nanophosphors are similar to those of the corresponding color emissions shown in FIGS. 4A to 4C. Light is additive. Where the solid state fixture in system 10 includes the blue, green and orange emitting doped semiconductor nanophosphors as shown for example at 27 in FIG. 1, the addition of the blue, green and orange emissions produces a combined spectrum as approximated by the top or 'Sum' curve in the graph of FIG. 5A.

Various mixtures of doped semiconductor nanophosphors will produce white light emissions from solid state light fixtures 12 that exhibit CRI of 75 or higher. For an intended fixture specification, a particular mixture of phosphors is chosen so that the light output of the fixture exhibits color temperature in one of the following specific ranges along the black body curve: 2,725±145° Kelvin; 3,045±175° Kelvin; 3,465±245° Kelvin; and 3,985±275° Kelvin. In the example shown in FIG. 5A, the 'Sum' curve in the graph produced by the mixture of blue, green and orange emitting doped semiconductor nanophosphors would result in a white light output having a color temperature of 2800° Kelvin (within the 2,725±145° Kelvin range). That white output light also would have a CRI of 80 (higher than 75).

The CIE color rendering index or "CRI" is a standardized measure of the ability of a light source to reproduce the colors of various objects, based on illumination of standard color targets by a source under test for comparison to illumination of such targets by a reference source. CRI, for example, is currently used as a metric to measure the color quality of white light sources for general lighting applications. Presently, CRI is the only accepted metric for assessing the color rendering performance of light sources. However, it has been recognized that the CRI has drawbacks that limit usefulness in assessing the color quality of light sources, particularly for LED based lighting products. NIST has recently been working on a Color Quality Scale (CQS) as an improved standardized metric for rating the ability of a light source to reproduce the colors of various objects. The color quality of the white light produced by the systems discussed herein is specified in terms of CRI, as that is the currently available/accepted metric. Those skilled in the art will recognize, however, that the systems may be rated in future by corresponding high measures of the quality of the white light outputs using appropriate values on the CQS once that scale is accepted as an appropriate industry standard. Of course, other even more accurate metrics for white light quality measurement may be developed in future.

It is possible to add one or more additional nanophosphors, e.g. a fourth, fifth, etc., to the mixture to further improve the CRI. For example, to improve the CRI of the nanophosphor mix of FIGS. 4A to 5A, a doped semiconductor nanophosphor might be added to the mix with a broad emissions spectrum that is yellowish-green or greenish-yellow, that is to say with a peak of the phosphor emissions somewhere in the range of 540-570 nm, say at 555 nm.

Other mixtures also are possible, with two, three or more doped semiconductor nanophosphors. The example of FIG. 5B uses red, green and blue emitting semiconductor nanophosphors, as well as a yellow fourth doped semiconductor nanophosphor. Although not shown, the absorption spectra would be similar to those of the three nanophosphors discussed above relative to FIGS. 4A to 4C. For example, each absorption spectrum would include at least a portion of the 380-420 nm near UV range. All four phosphors would exhibit a large Stokes shift from the short wavelength(s) of absorbed light to the longer wavelengths of re-emitted light, and thus their emissions spectra have little or not overlap with the absorption spectra.

In this example (FIG. 5B), the blue nanophosphor exhibits an emission peak at or around 484, nm, the green nanophosphor exhibits an emission peak at or around 516 nm, the yellow nanophosphor exhibits an emission peak at or around 580, and the red nanophosphor exhibits an emission peak at or around 610 nm. The addition of these blue, green, red and yellow phosphor emissions produces a combined spectrum as approximated by the top or 'Sum' curve in the graph of FIG. 5B. The 'Sum' curve in the graph represents a resultant white light output having a color temperature of 2600° Kelvin (within the 2,725±145° Kelvin range), where that white output light also would have a CRI of 88 (higher than 75).

Returning to FIG. 1, assume that the phosphors in the material at 16 in the fixture of the system 10 include the blue, green and orange emitting doped semiconductor nanophosphors discussed above relative to FIGS. 4A to 5A. As discussed earlier, the exemplary semiconductor LED chip formed by layers 13 and 15 is rated to emit near UV electromagnetic energy of a wavelength in the range of ≦460 nm, such as 405 nm in the illustrated example, which is within the excitation or absorption spectrum of each of the three included phosphors in the mixture shown at 16. When excited, that combination of doped semiconductor nanophosphors re-emits the various wavelengths of visible light represented by the blue, green and orange lines in the graph of FIG. 5A. Combination or addition thereof in the fixture output produces "white" light, which for purposes of our discussion herein is light that is at least substantially white light. The white light emission from the solid state fixture in system 10 exhibits a CRI of 75 or higher (80 in the specific example of FIG. 5A). Also, the light output of the fixture exhibits color temperature of 2800° Kelvin, that is to say within the 2,725±145° Kelvin range. Other combinations of doped semiconductor nanophosphors can be used in a solid state lighting system 10 to produce the high CRI white light in the 3,045±175° Kelvin, 3,465±245° Kelvin, and 3,985±275° Kelvin ranges.

This system 10 provides a "remote" implementation of the semiconductor nanophosphors in that the semiconductor nanophosphors are deployed outside of the package enclosing the actual semiconductor chip or chips and thus are apart or remote from the semiconductor chip(s), that is to say, in the optical processing element or apparatus 14, 16 in this first example. The remote semiconductor nanophosphors in the material at 16 may be provided in or about the optic 12 in any of a number of different ways, such as along any suitable portion of the inner reflective surface 29 of the macro reflector 27, in the form of a container or coating. Several different locations of the material with the semiconductor nanophosphors are shown and described with regard to later examples. In the first example of FIG. 1, the container 14 extends across a portion of the volume within the reflector 27 across the path of energy emissions from the source 11 through the optic 12.

At least some semiconductor nanophosphors degrade in the presence of oxygen, reducing the useful life of the semiconductor nanophosphors. Hence, it may be desirable to encapsulate the semiconductor nanophosphor bearing material 16 in a manner that blocks out oxygen, to prolong useful life of the semiconductor nanophosphors. In the example of FIG. 1, the container 14 therefore may be a sealed glass container, the material of which is highly transmissive and exhibits a low absorption with respect to visible light and the relevant wavelength(s) of near UV energy. The interior of the container 14 is filled with the semiconductor nanophosphor bearing material 16. Any of a number of various sealing arrangements may be used to seal the interior once filled, so as to maintain a good oxygen barrier and thereby shield the semiconductor nanophosphors from oxygen.

Figure 6:
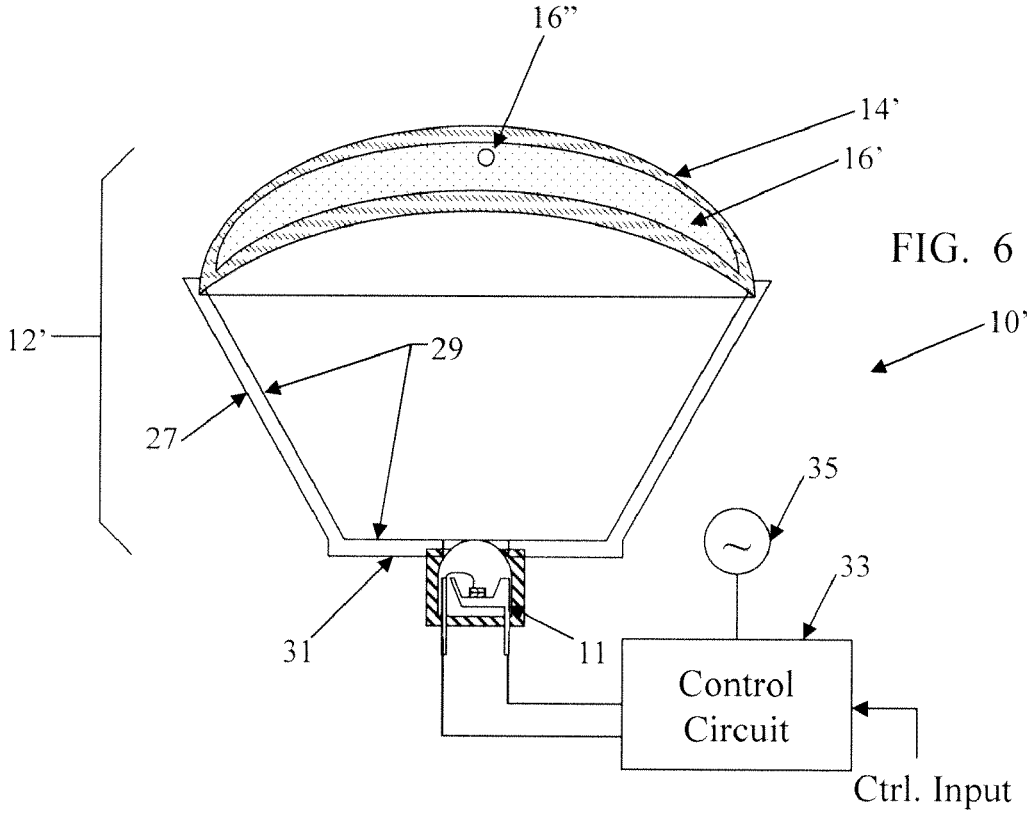
FIG. 6 illustrates an example of a white light emitting system, similar to that of FIG. 1, but using a different configuration/position for the container for the doped semiconductor nanophosphor material.

The container 14 and the semiconductor nanophosphor bearing material 16 may be located at any convenient distance in relation to the proximal end 31 of the reflector 27 and the solid state source 11. For example, the container 14 and the semiconductor nanophosphor bearing material 16 could be located adjacent to the proximal end 31 of the reflector 27 (adjacent to that part of the reflective surface 29) and adjacent to the solid state source 11. Alternatively, as shown by the system 10' of FIG. 6, the container 14' and the nanophosphor bearing material 16' in the optic 12' could be located at or near the distal end of the reflector 27. The container may also have a wide variety of shapes. In the example of FIG. 1, the container 14 is relatively flat and disk-shaped. In the example of FIG. 6, the container 14' has a convex outer curvature, although it could be convex or concave. The inner surface of the container 14' facing toward the solid state source 11 and the reflective surface 29 may be flat, concave or convex (as shown). Those skilled in the art will also recognize that the optic 12 or 12' could include a variety of other optical processing elements, such as a further reflector, one or more lenses, a diffuser, a collimator, etc.

Other container arrangements are contemplated. For example, the reflector 27 might serve as the container. In such an arrangement, the distal end of the reflector would have a transmissive optical aperture for energy to enter from the LED 11, although the material would seal the reflector at that point. The distal end of the reflector 27 might then be sealed to form the container by means of a transmissive plate, lens or diffuser, for example, formed of glass. A glass container might be used that is shaped like the reflector 27 but has reflective coatings on the appropriate interior surfaces 29. In these cases, the material bearing the nanophosphors would fill substantially all of the interior volume of the reflector 27.

The lighting system 10 (or 10') also includes a control circuit 33 coupled to the LED type semiconductor chip in the source 11, for establishing output intensity of electromagnetic energy output of the LED type source 11. The control circuit 33 typically includes a power supply circuit coupled to a voltage/current source, shown as an AC power source 35. Of course, batteries or other types of power sources may be used, and the control circuit 33 will provide the conversion of the source power to the voltage/current appropriate to the particular one or more LEDs 11 utilized in the system 10 (or 10'). The control circuit 33 includes one or more LED driver circuits for controlling the power applied to one or more sources 11 and thus the intensity of energy output of the source. Intensity of the phosphor emissions are proportional to the intensity of the energy pumping the nanophosphors, therefore control of the LED output controls the intensity of the light output of the fixture. The control circuit 33 may be responsive to a number of different control input signals, for example to one or more user inputs as shown by the arrow in FIG. 1, to turn power ON/OFF and/or to set a desired intensity level for the white light output provided by the system 10 or 10'.

In the exemplary arrangement of the optic 12 (or 12'), near UV light energy from the 405 nm solid state source 11 enters the interior volume of the reflector 27 and passes through the outer glass of the container 14 into the material 16 bearing the semiconductor nanophosphors. Much of the near UV emissions enter the container directly, although some reflect off of the surface 29 and into the container. Within the container 14 or 14', the 405 nm near UV energy excites the semiconductor nanophosphors in material 16 to produce light that is at least substantially white, that exhibits a CRI of 75 or higher and that exhibits color temperature in one of the specified ranges (see Table 1 above). Light resulting from the semiconductor nanophosphor excitation, essentially absorbed as near UV energy and reemitted as visible light of the wavelengths forming the desired white light, passes out through the material 16 and the container 14 or 14' in all directions. Some light emerges directly out of the optic 12 as represented by the undulating arrows in FIG. 1. However, some of the white light will also reflect off of various parts of the surface 29. Some light may even pass through the container and semiconductor nanophosphor material again before emission from the optic.

In the orientation illustrated in FIGS. 1 and 6, white light from the semiconductor nanophosphor excitation, including any white light emissions reflected by the surface 29 are directed upwards, for example, for lighting a ceiling so as to indirectly illuminate a room or other habitable space below the fixture. The orientation shown, however, is purely illustrative. The optic 12 or 12' may be oriented in any other direction appropriate for the desired lighting application, including downward, any sideways direction, various intermediate angles, etc. Also, the examples of FIGS. 1 and 6 utilize relatively flat reflective surfaces for ease of illustration. Those skilled in the art will recognize, however, that the principles of those examples are applicable to optics of other shapes and configurations, including optics that use various curved reflective surfaces (e.g. hemispherical, semi-cylindrical, parabolic, etc.).

The nanophosphor-centric solid state lighting technology discussed herein, using a material bearing one or more nanophosphors dispersed therein, may be adapted to a variety of different fixture optic structures with various types of reflectors, diffusers or the like. Several additional fixture examples are discussed in some detail in the above incorporated applications.

Although fixtures without reflectors may use the remote nanophosphors, the examples specifically discussed above relative to FIGS. 1-5 include a reflector 27 forming or as part of the optic 12. Various types of reflectors may be used. It is also contemplated that the reflector might be configured to form an optical integrating cavity. In such an implementation of the fixture, the reflector receives and diffusely reflects the input energy and/or the visible light emitted by the doped semiconductor nanophosphors to produce an integrated light output. The emission spectrum of the output includes visible light of the emission spectra of the various nanophosphors dispersed in the material. The container may be coupled to the cavity in different ways. For example, the container could be at or near the LED inputs to the cavity, at the output aperture of the cavity, at a location on the reflective interior surface forming the cavity. It may be helpful to consider an optical cavity example, in somewhat more detail.

Figure 7:
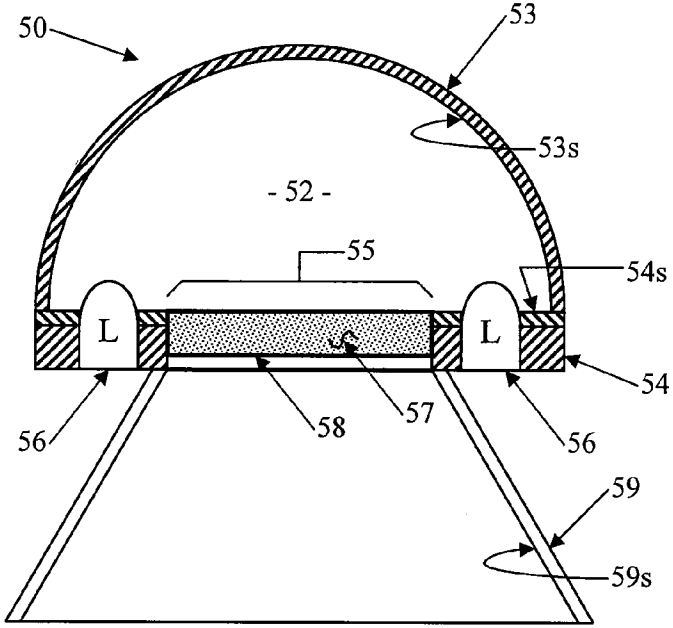
FIG. 7 is a cross section of a light fixture for a general lighting application, using solid state light emitters, an optical integrating cavity, a deflector or concentrator and a liquid containing quantum dots.

FIG. 7 illustrates an example of a lighting fixture having LED type solid state light sources, an optical integrating chamber and a liquid containing quantum dots as the semiconductor nanophosphors. At a high level, the solid state lighting fixture 50 of FIG. 7 includes a chamber, in this example, an optical integrating cavity 52 formed by a dome 53 and a plate 54. The cavity 52 has a diffusely reflective interior surface 53*s* and/or 54*s* and a transmissive optical passage 55. The lighting apparatus 50 also includes a source of light of a first spectral characteristic of sufficient light intensity for a general lighting application, in this example, two or more solid state light sources 56. The lighting fixture 50 utilizes quantum dots in a liquid 57 within a container 58, for producing a wavelength shift of at least some light from the source(s) 56 to produce a desired color characteristic in the processed light emitted from the optical passage or aperture 55 of the chamber 52. In this example, the container 58 with the nanophosphor bearing material is the apparatus or optical element for producing visible light in response to electromagnetic energy from a solid state source(s) 56 in the fixture 50. The intensity of light produced by the light source, e.g. the solid state light emitter(s) 56, is sufficient for the light output of the device 50 to support the general lighting application.

For convenience, the lighting device or fixture in this example is shown emitting the light downward from the aperture 55, possibly via an additional optical processing element such as a deflector or concentrator (e.g. deflector 59 in FIG. 1). However, the fixture 50 may be oriented in any desired direction to perform a desired general lighting application function. The aperture or a further optical processing element may provide the ultimate output of the device 50 for a particular general lighting application. As discussed in detail with regard to FIG. 7, but applicable to other integrating cavity examples like FIG. 9 and/or in several of the above-incorporated applications, circular or hemispherical shapes are shown and discussed most often for convenience, although a variety of other shapes may be used.

Hence, as shown in FIG. 7, an exemplary general lighting fixture 50 includes an optical integrating cavity 52 having a reflective interior surface 53*s*, 54*s*. The cavity 52 is a diffuse optical processing element used to convert a point source input, typically at an arbitrary point not visible from the outside, to a virtual source. At least a portion of the interior surface of the cavity 52 exhibits a diffuse reflectivity.

The cavity 52 may have various shapes. The illustrated cross-section would be substantially the same if the cavity is hemispherical or if the cavity is semi-cylindrical with a lateral cross-section taken perpendicular to the longitudinal axis of the semi-cylinder. For purposes of the discussion, the cavity 52 in the fixture 50 is assumed to be hemispherical or nearly hemispherical. In such an example, a hemispherical dome 53 and a substantially flat cover plate or mask 54 form the optical cavity 52. Although shown as separate elements, the dome and plate may be formed as an integral unit. The plate is shown as a flat horizontal member, for convenience, although curved or angled configurations may be used. At least the interior facing surface(s) 53*s* of the dome 53 is highly diffusely reflective, so that the resulting cavity 52 is highly diffusely reflective with respect to the radiant energy spectrum produced by the fixture 50. The interior facing surface(s) 54*s* of the plate 54 is reflective, typically specular or diffusely reflective. In the example, the dome 53 itself is formed of a diffusely reflective material, whereas the plate 54 may be a circuit board or the like on which a coating or layer of reflective material is added or mounted to form the reflective surface 54*s*.

It is desirable that the diffusely reflective cavity surface(s) have a highly efficient reflective characteristic, e.g. a reflectivity equal to or greater than 90%, with respect to the relevant wavelengths. The entire interior surface (surfaces 53*s*, 54*s* of the dome and plate) may be diffusely reflective, or one or more substantial portions may be diffusely reflective while other portion(s) of the cavity surface may have different light reflective characteristics. In some examples, one or more other portions are substantially specular or are semi or quasi specular.

The elements 53 and 54 of the cavity 52 may be formed of a diffusely reflective plastic material, such as a polypropylene having a 97% reflectivity and a diffuse reflective characteristic. Such a highly reflective polypropylene is available from Ferro Corporation—Specialty Plastics Group, Filled and Reinforced Plastics Division, in Evansville, Ind. Another example of a material with a suitable reflectivity is SPECTRALON. Alternatively, each element of the optical integrating cavity may comprise a rigid substrate having an interior surface, and a diffusely reflective coating layer formed on the interior surface of the substrate so as to provide the diffusely reflective interior surface of the optical integrating cavity. The coating layer, for example, might take the form of a flat-white paint or white powder coat. A suitable paint might include a zinc-oxide based pigment, consisting essentially of an uncalcined zinc oxide and preferably containing a small amount of a dispersing agent. The pigment is mixed with an alkali metal silicate vehicle-binder, which preferably is a potassium silicate, to form the coating material. For more information regarding exemplary paints, attention is directed to U.S. Pat. No. 6,700,112 by Matthew Brown. Of course, those skilled in the art will recognize that a variety of other diffusely reflective materials may be used. Other diffuse reflective materials are also discussed in some of the above-incorporated applications.

In this example, the cavity 52 forms an integrating type optical cavity. The cavity 52 has a transmissive optical aperture 55, which allows emission of reflected and diffused light from within the interior of the cavity 52 into a region to facilitate a humanly perceptible general lighting application for the fixture 50. Although shown at approximately the center of the plate 54, the opening or transmissive passage forming the optical aperture 55 may be located elsewhere along the plate or at some appropriate region of the dome. In the example, the aperture 55 forms the virtual source of the light from lighting fixture 50. The fixture will have a material bearing quantum dots as the nanophosphor(s). The material may be solid or gaseous as in the earlier examples. As discussed more later, the fixture 50 in this example includes a quantum dot liquid material 57. Although the liquid may be provided in a number of different ways, in this example, a container 58 of quantum dot liquid 57 is mounted in the aperture 55.

The lighting fixture 50 also includes at least one source of light energy. The fixture geometry may be used with any appropriate type of solid state light sources, however, as in the earlier examples, the source takes the form of one or more light emitting diodes (L), represented by the two LEDs (L) 56 in the cross-section drawing. Although the LEDs (L) 56 may emit a single type of visible light, a number of colors of visible light or a combination of visible light and at least one light wavelength in another part of the electromagnetic spectrum selected to pump the quantum dots, we will assume here that all of the LEDs 56 are rated for emitting electromagnetic energy at a wavelength in the range of 460 nm and below ($\lambda \leqq 460$ nm).

The LEDs (L) 56 may be positioned at a variety of different locations and/or oriented in different directions. Various couplings and various light entry locations may be used. In this and other examples, each LED (L) 56 is coupled to supply light to enter the cavity 52 at a point that directs the light toward a reflective surface so that it reflects one or more times inside the cavity 52, and at least one such reflection is a diffuse reflection. As a result, the direct emissions from the sources 56 would not directly pass through the optical aperture 55, or in this example, directly impact on the liquid 57 in the container 58 mounted in the aperture 55. In examples where the aperture is open or transparent, the points of emission into the cavity are not directly observable through the aperture 55 from the region illuminated by the fixture output. The LEDs (L) 56 therefore are not perceptible as point light sources of high intensity, from the perspective of an area illuminated by the light fixture 50.

Electromagnetic energy, typically in the form of light energy and/or UV energy from the one or more LEDs (L) 56, is diffusely reflected and combined within the cavity 52 to form combined light and form a virtual source of such combined light at the aperture 55. Such integration, for example, may combine light from multiple sources or spread light from one small source across the broader area of the aperture 55. The integration tends to form a relatively Lambertian distribution across the virtual source. When the fixture illumination is viewed from the area illuminated by the combined light, the virtual source at aperture 55 appears to have substantially infinite depth of the integrated light. Also, the visible intensity is spread uniformly across the virtual source, as opposed to one or more individual small point sources of higher intensity as would be seen if the one or more LED source elements (L) 56 were directly observable without sufficient diffuse processing before emission through the aperture 55.

Pixelation and color striation are problems with many prior solid state lighting devices. When a non-cavity type LED fixture output is observed, the light output from individual LEDs or the like appear as identifiable/individual point sources or 'pixels.' Even with diffusers or other forms of common mixing, the pixels of the sources are apparent. The observable output of such a prior system exhibits a high maximum-to-minimum intensity ratio. In systems using multiple light color sources, e.g. RGB LEDs, unless observed from a substantial distance from the fixture, the light from the fixture often exhibits striations or separation bands of different colors.

Integrating cavity type systems and light fixtures as disclosed herein, however, do not exhibit such pixilation or striations. Instead, the diffuse optical processing in the chamber converts the point source output(s) of the one or more solid state light emitting elements to a virtual source output of light, at the aperture 55 in the examples using optical cavity processing. The virtual source output is unpixelated and relatively uniform across the apparent output area of the fixture, e.g. across the optical aperture 55 of the cavity 52 and/or across the container 58 in the aperture in this first example (FIG. 7). The optical integration sufficiently mixes the light from the solid state light emitting elements 56 that the combined light output of the virtual source is at least substantially Lambertian in distribution across the optical output area of the cavity, that is to say across the aperture 55 of the cavity 52. As a result, the light output exhibits a relatively low maximum-to-minimum intensity ratio across the aperture 55. In virtual source examples discussed herein, the virtual source light output exhibits a maximum to minimum ratio of 2 to 1 or less over substantially the entire optical output area. The area of the virtual source is at least one order of magnitude larger than the area of the point source output of the solid state emitter 56. The virtual source examples rely on various implementations of the optical integrating cavity 52 as the mixing element to achieve this level of output uniformity at the virtual source, however, other mixing elements could be used if they are configured to produce a virtual source with such a uniform output (Lambertian and/or relatively low maximum-to-minimum intensity ratio across the fixture's optical output area).

The diffuse optical processing may convert a single small area (point) source of light from a solid state emitter 56 to a broader area virtual source at the aperture. The diffuse optical processing can also combine a number of such point source outputs to form one virtual source. The quantum dots in the material 57 encapsulated in the container 58 of the optical processing element are used to shift color with respect to at least some light output of the virtual source.

In accord with the present teachings, the fixture 50 also includes a liquid material 57 containing quantum dots type semiconductor nanophosphors. In this example, the fixture 50 includes an apparatus for producing visible light in response to electromagnetic energy from a solid state source, in the form of a container 58 encapsulating the liquid 57; and the container 58 is located in the aperture 55. In a manner similar to the examples of FIGS. 1 and 5, the liquid 57 is a transmissive material. The material is of a type and the nanophosphor (s) are dispersed therein in such a manner that the material bearing the semiconductor nanophosphor(s) appears at least substantially color-neutral to the human observer, when the solid state lighting device is off. The material may be clear or translucent, although optical properties of the material, such as absorption and/or scattering, are independent of wavelength at least over much of the visible light spectrum.

The liquid material 57 in the lighting fixture 50 includes quantum dots sized to provide a color shift that is desirable, for the general lighting application of the fixture 50. For example, if the LEDs (L) 56 produce an integrated light output of a bluish character, the quantum dots in the liquid 57 could be selected to increase the amount of yellow and/or red light in the virtual source output and thereby produce a desired color temperature of white light. The shift provided by the quantum dots in the liquid 57 may also serve to shift light energy into the visible portion of the spectrum. For example, if one or more of the LEDs (L) 56 emit UV light, the quantum dots of appropriate materials and sizes could shift that light to one or more desirable wavelengths in the visible portion of the spectrum. If the LEDs are UV or near UV LEDs and the nanophosphors are the same as in any of the examples of FIGS. 1-6, then the light output would be a high CRI white light of one of the color temperatures listed in Table 1 above.

The aperture 55 (and/or passage through liquid 57 and container 58) may serve as the light output if the fixture 50, directing integrated light of relatively uniform intensity distribution to a desired area or region to be illuminated in accord with the general lighting application. It is also contemplated that the fixture 50 may include one or more additional processing elements coupled to the aperture, such as a colliminator, a grate, lens or diffuser (e.g. a holographic element). In the first example, the fixture 50 includes a further optical processing element in the form of a deflector or concentrator 59 coupled to the aperture 55, to distribute and/or limit the light output to a desired field of illumination.

The deflector or concentrator 59 has a reflective inner surface 59*s*, to efficiently direct most of the light emerging from the cavity and the liquid into a relatively narrow field of view. A small opening at a proximal end of the deflector 59 is coupled to the aperture 55 of the optical integrating cavity 52. The deflector 59 has a larger opening at a distal end thereof. Although other shapes may be used, such as parabolic reflectors, the deflector 59 in this example is conical, essentially in the shape of a truncated cone. The angle of the cone wall(s) and the size of the distal opening of the conical deflector 59 define an angular field of light energy emission from the device 50. Although not shown, the large opening of the deflector may be covered with a transparent plate or lens, or covered with a grating, to prevent entry of dirt or debris through the cone into the fixture 50 and/or to further process the output light energy.

The conical deflector 59 may have a variety of different shapes, depending on the particular lighting application. In the example, where cavity 52 is hemispherical, the cross-section of the conical deflector 59 is typically circular. However, the deflector 59 may be somewhat oval in shape. Although the aperture 55 may be round, the distal opening may have other shapes (e.g. oval, rectangular or square); in which case, more curved deflector walls provide a transition from round at the aperture coupling to the alternate shape at the distal opening. In applications using a semi-cylindrical cavity, the deflector may be elongated or even rectangular in cross-section. The shape of the aperture 55 also may vary, but will typically match the shape of the small end opening of the deflector 59. Hence, in the example, the aperture 55 would be circular as would the matching proximal opening at the small end of the conical deflector 59. However, for a device with a semi-cylindrical cavity and a deflector with a rectangular cross-section, the aperture and associated deflector opening may be rectangular with square or rounded corners.

The deflector 59 comprises a reflective interior surface 59*s* between the distal end and the proximal end. In some examples, at least a substantial portion of the reflective interior surface 59*s* of the conical deflector 59 exhibits specular reflectivity with respect to the integrated radiant energy. As discussed in U.S. Pat. No. 6,007,225, for some applications, it may be desirable to construct the deflector 59 so that at least some portion(s) of the inner surface 59*s* exhibit diffuse reflectivity or exhibit a different degree of specular reflectivity (e.g., quasi-secular), so as to tailor the performance of the deflector 59 to the particular general lighting application. For other applications, it may also be desirable for the entire interior surface 59*s* of the deflector 59 to have a diffuse reflective characteristic. In such cases, the deflector 59 may be constructed using materials similar to those taught above for construction of the optical integrating cavity 52. In addition to reflectivity, the deflector may be implemented in different colors (e.g. silver, gold, red, etc.) along all or part of the reflective interior surface 59*s*.

In the illustrated example, the large distal opening of the deflector 59 is roughly the same size as the cavity 52. In some applications, this size relationship may be convenient for construction purposes. However, a direct relationship in size of the distal end of the deflector and the cavity is not required. The large end of the deflector may be larger or smaller than the cavity structure. As a practical matter, the size of the cavity is optimized to provide effective integration or combination of light from the desired number of LED type solid state sources 56. The size, angle and shape of the deflector 59 determine the area that will be illuminated by the combined or integrated light emitted from the cavity 52 via the aperture 55 and the phosphor bearing liquid 57.

For convenience, the illustration shows the lighting device 50 emitting the light downward from the virtual source, that is to say downward through the aperture 55 and the liquid 57. However, the lighting device 50 may be oriented in any desired direction to perform a desired general lighting application function. Also, the optical integrating cavity 52 may have more than one optical aperture or passage, for example, oriented to allow emission of integrated light in two or more different directions or regions. The additional optical passage may be an opening or may be a partially transmissive or translucent region of a wall of the cavity.

A system incorporating the light fixture 50 may also include a controller, like the controller 33 in the example of FIG. 1.

Figure 8:
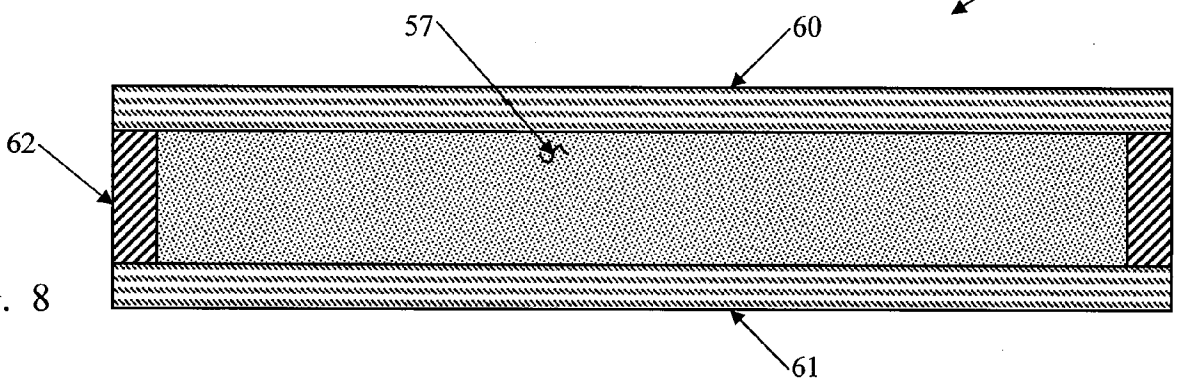
FIG. 8 is an enlarged cross-sectional view of the liquid filled container used in the light fixture of FIG. 7.

Those skilled in the art will recognize that the container 58 for the quantum dot liquid 57 may be constructed in a variety of ways. FIG. 8 is a cross-sectional view of one example. As noted above, for simplicity, we have assumed that the aperture 55 in the embodiment of FIG. 7 is circular. Hence, the container 8 would also be circular and sized to fit in the aperture 55. As shown in cross-section in FIG. 8, the container 58 includes two light transmissive elements 60 and 61, which may be transparent or translucent. The element 60 would be the portion of the structure that receives the electromagnetic energy from the LEDs 56 forming the source or sources, in this example, and that portion would most likely be transparent. The element 61 would be the portion through which phosphor emissions would be emitted out of the device, even if emitted back into the cavity 52 for further reflection and passage out through the optical processing element 58. The element 61 would be transmissive with respect to at least visible light, although it may be transparent or translucent.

The elements 60 and 61, for example, may be formed of a suitable glass or acrylic material. The elements 60 and 61 may be glued to or otherwise attached to a sealing ring 12. When so attached, the sealing ring provides an air tight and liquid tight seal for the volume between the elements 60 and 61. The liquid 57 substantially fills the volume of the container formed by the elements 60 and 61 and the sealing ring 62, with little or no air entrained in the liquid 67. If under low pressure, some of the liquid may transition to the gaseous state within the interior of the container, for example, if the cavity is filled with the liquid in a heated state and the liquid cools after the filled container is sealed.

The height of the container 58 (vertical in the illustrated orientation of FIGS. 7 and 8) may be selected to provide an adequate volume for a desired amount of the liquid 57. The height of the container may be less than, equal to or greater than the height of the opening through the board 54 that forms the aperture 55.

The quantum dots dispersed in the liquid 57 will be selected to facilitate a particular lighting application for the fixture 50. That is to say, for a given spectrum of light produced by the LEDs (L) 56 and the diffusely reflective cavity 52, the material and sizing of the quantum dots will be such as to shift at least some of the light emerging through the aperture 55 in a desired manner.

Quantum dots are often produced in solution. Near the final production stage, the quantum dots are contained in a liquid solvent. This liquid solution could be used as the quantum dot solution 57. However, the solvents tend to be rather volatile/flammable, and other liquids such as water may be used. The quantum dots may be contained in a dissolved state in solution, or the liquid and quantum dots may form an emulsion. The liquid itself may be transparent, or the liquid may have a scattering or diffusing effect of its own (caused by an additional scattering agent in the liquid or by the translucent nature of the particular liquid). However, the liquid is of a type and the quantum dot nanophosphor(s) are dispersed therein in such a manner that the material bearing the semiconductor nanophosphor(s) appears at least substantially color-neutral, clear or neutral translucent white to the human observer, when the solid state lighting device is off.

In the example of FIGS. 7 and 8, some light entering the container 58 through the upper element 60 may pass through the liquid 67 without interacting with any of the quantum dots. Other light from the cavity 52 will interact with the quantum dots. Light that interacts with the quantum dots will be absorbed by the dots and re-emitted by the dots at a different wavelength. Some of the light emitted from the quantum dots in the liquid 57 will be emitted back through the element 60 into the cavity 52, for diffuse reflection and integration with light from the LEDs (L) 56, for later emission through the aperture 55, the liquid 57 and the elements 60 and 61 of the container 58. Other light emitted from the quantum dots in the liquid 57 will be emitted through the element 61, that is to say together with any light that may pass through the liquid 57 without interacting with any of the quantum dots. In this way, light emerging from the fixture 50 via the aperture 55, the container 58 and the liquid material 57 bearing the nanophosphors may include some integrated light from within the cavity 52 as well as some light shifted by interaction (absorption and re-emission) via the quantum dots contained in the liquid 57. Unless all of the LEDs are UV emitters (all pumping quantum dots), the spectrum of light emitted from the apparatus 50 thus includes at least some of the light from the LEDs (L) 56 as well as one or more wavelengths of the light shifted by the quantum dots. This combination of light provides the desired spectral characteristic of the fixture output, that is to say, for the intended general lighting application.

In the example of FIGS. 7 and 8, the container 58 took the form of a flat disk. However, the container may have a variety of other shapes. Further examples are discussed in the above-incorporated applications. Different shapes and/or textures may be chosen to facilitate a particular output distribution pattern and/or efficient extraction of integrated light from the cavity.

The cavity examples discussed so far, relative to FIGS. 7 and 8, have utilized a container for the liquid that effectively positions the liquid in the optical aperture to form a light transmissive passage for integrated light emerging as a uniform virtual source from the integrating cavity. Those skilled in the art will recognize that the liquid may be provided in the fixture in a variety of other ways and/or at other locations. In particular, it may be desirable to substantially fill the volume of the optical integrating cavity with the nanophosphor bearing material. It may be helpful to consider an example of a liquid filled cavity arrangement.

Figure 9:
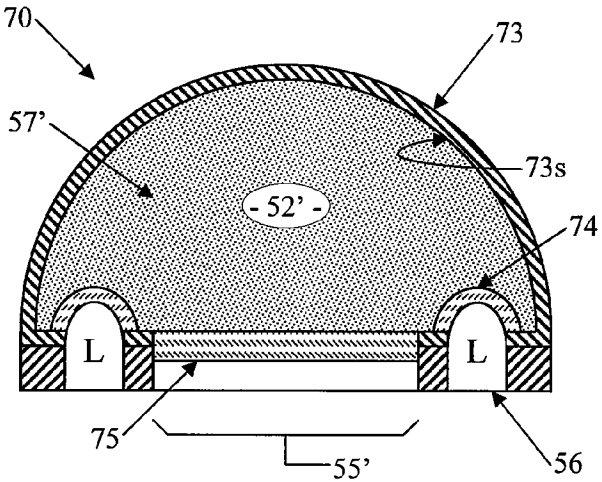
FIG. 9 is a cross-section of another light fixture for a general lighting application, in which an optical integrating cavity is sealed to form the container for the liquid containing the quantum dots.

FIG. 9 therefore shows a fixture 70 in which the liquid 57' substantially fills the optical integrating cavity 52'. As in the example of FIG. 7, the lighting fixture 70 has solid state light sources, again exemplified by a number of LEDs (L) 56. The fixture 70 also includes an optical integrating cavity 52 that itself contains the liquid 57' bearing the dispersed quantum dots.

In this example, the cavity 52' is formed by a material having a diffusely reflective interior surface or surfaces, in the shape of an integral member 73 forming both the dome and the plate. The material of the member 53 is chosen to provide a sealed liquid container, but the interior surface or surfaces of the member use materials similar to those described above in the discussion of FIG. 7 to provide the desired diffuse reflectivity on some or all of the internal surface(s) 73*s* with respect to light in the cavity 52'. Again, although a variety of shapes may be used, we will assume that the cavity 52' takes the shape of a hemisphere, for ease of illustration and discussion. Openings through the member 53 are sealed in an air tight and liquid tight manner. For example, openings for the LEDs (L) 56 may be sealed by covering the LEDs with an optical adhesive or similar light transmissive sealant material as shown at 74, which protects the LEDs from the liquid 57' and seals the spaces between the LEDs and the surrounding structure of the member 73. The light transmissive sealant material 74 is the portion of the container formed by the optical integrating cavity through which the apparatus containing the liquid with the nanophosphors receives electromagnetic energy from the LEDs 56, and typically the sealant material 74 would be transparent.

The member 73 in this example also has an aperture 55' through which integrated light emerges from the cavity 52'. One or more additional optical processing elements may be coupled to the aperture, such as the deflector discussed above relative to the example of FIG. 7. However, in this example, the aperture 55' provides the uniform virtual source and the output of the light fixture 70. To contain the liquid 57, this aperture 55' is sealed with a light transmissive plug 75, for example, formed of a suitable plastic or glass. The plug may be pressed into the aperture, but typically, a glue or other sealant is used around the edges of the plug 75 to prevent air or liquid leakage. The light transmissive plug 75 is the portion of the container formed by the optical integrating cavity through which the apparatus containing the liquid with the nanophosphors emits light generated by excitation of the nanophosphors. The light transmissive plug 75 in the aperture 55' may be transparent, or it may be translucent so as to provide additional light diffusion. As in the earlier examples, the liquid is of a type and the quantum dot nanophosphor(s) are dispersed therein in such a manner that the material bearing the semiconductor nanophosphor(s) appears at least substantially color-neutral to the human observer, when the solid state lighting device is off.

Again, each LED (L) 56 is coupled to supply light to enter the cavity 52' at a point that directs the light toward a reflective surface 73' so that it reflects one or more times inside the cavity 52', and at least one such reflection is a diffuse reflection. As the light from the LEDs (L) 56 passes one or more times through the volume of the cavity 52', the light also passes one or more times through the liquid 57'. As in the earlier example, the liquid contains quantum dots. Some light interacts with the quantum dots to produce a shift. Some of the shifted light passes directly through the aperture 55', and some of the shifted light reflects off the reflective surface(s) 73 of the cavity 52'. The cavity 52' acts as an optical integrating cavity to produce optically integrated light of a uniform character forming a uniform virtual source at the aperture 55'. The integrated light output may include some light from the sources 56 and includes substantial amounts of the light shifted by the quantum dots of the liquid 57'. The output exhibits similar uniform virtual source characteristics to the light at the aperture in the example of FIG. 7; but in the example of FIG. 9, the integration of the shifted light is completed within the cavity 52' before passage through the optical aperture 55.

In the examples of FIGS. 1-9, the apparatus for producing visible light in response to electromagnetic energy from a solid state source took the form of an optical processing element configured for incorporation in a solid state light fixture. However, the present teachings encompass use of the technology in other types of solid state lighting devices, such as a tubular or bulb type lamp product. To appreciate such a use, it may be helpful to consider an example of a lamp.

Figure 10:
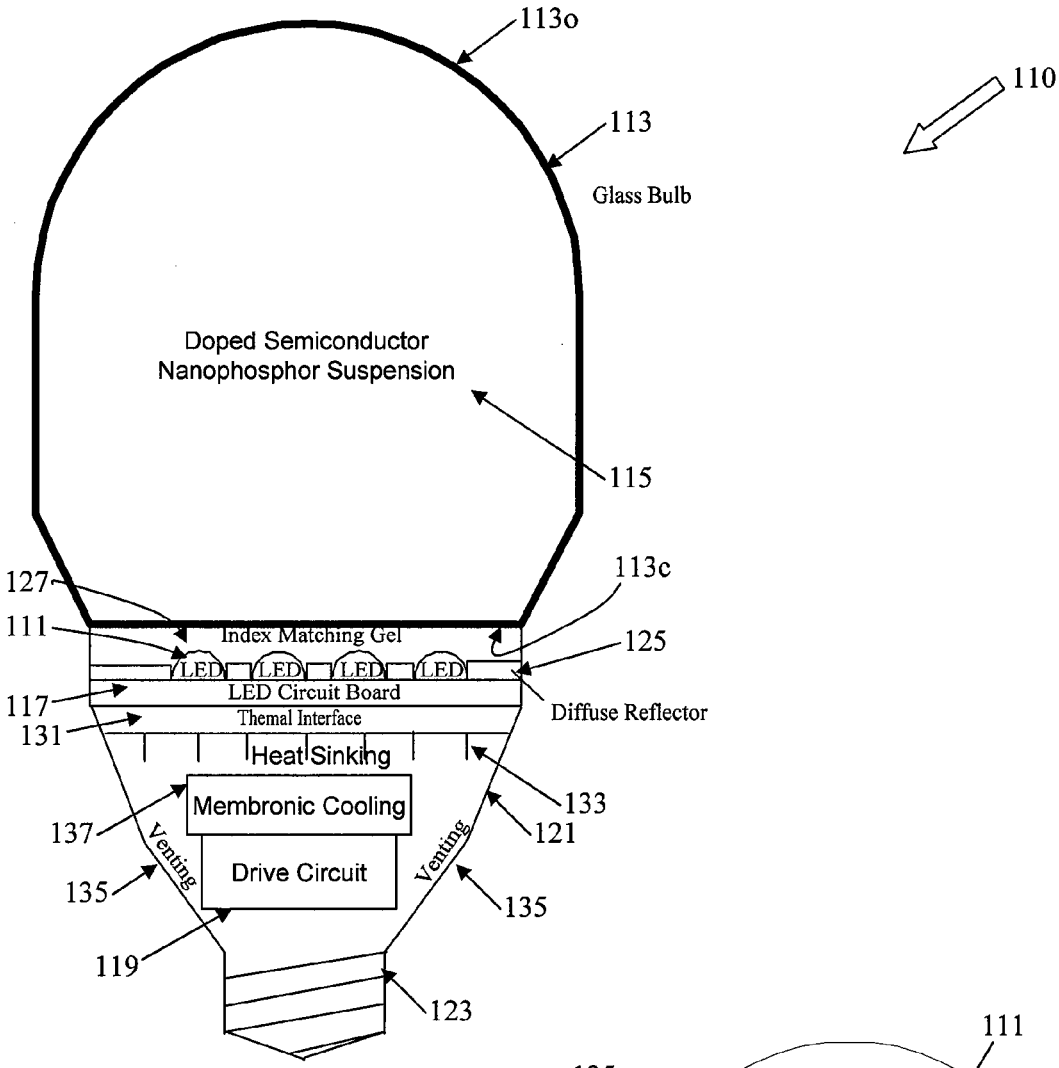
FIG. 10 is a cross-sectional view of an example of a solid state lamp, for lighting applications, which uses a solid state source and one or more doped nanophosphors pumped by energy from the source to produce visible light.

FIG. 10 illustrates an example of a solid state lamp 110, in cross section. The exemplary lamp 110 may be utilized in a variety of lighting applications. The lamp, for example includes a solid state source for producing electromagnetic energy. The solid state source is a semiconductor based structure for emitting electromagnetic energy of one or more wavelengths within the range to excite the nanophosphors used in the particular lamp. In the example, the source comprises one or more light emitting diode (LED) devices, although other semiconductor devices might be used. Hence, in the example of FIG. 10, the source takes the form of a number of LEDs 111.

It is contemplated that the LEDs 111 could be of any type rated to emit energy of wavelengths from the blue/green region around 460 nm down into the UV range below 380 nm. Although quantum dots or other nanophosphors could be used, we will assume that the lamp 110 uses doped semiconductors like those discussed above relative to FIGS. 4A to 5B. As discussed earlier, the exemplary nanophosphors have absorption spectra having upper limits around 460 nm or below. In the specific examples, including some for white light lamp applications, the LEDs 111 are near UV LEDs rated for emission somewhere in the 380-420 nm range, although UV LEDs could be used alone or in combination with near UV LEDs even with the exemplary nanophosphors. A specific example of a near UV LED, used in several of the specific white lamp examples, is rated for 405 nm emission.

One or more doped semiconductor nanophosphors are used in the lamp 110 to convert energy from the source into visible light of one or more wavelengths to produce a desired characteristic of the visible light output of the lamp. The doped semiconductor nanophosphors are remotely deployed, in that they are outside of the individual device packages or housings of the LEDs 111. For this purpose, the exemplary lamp includes an apparatus in the form of container formed of optically transmissive material coupled to receive and process near UV electromagnetic energy from the LEDs 111 forming the solid state source. The container contains a material, which at least substantially fills the interior volume of the container. For example, if a liquid is used, there may be some gas in the container as well, although the gas should not include oxygen as oxygen tends to degrade the nanophosphors. In this example, the lamp includes at least one doped semiconductor nanophosphor dispersed in the material in the container.

The material may be a solid, although liquid or gaseous materials may help to improve the florescent emissions by the nanophosphors in the material, as discussed earlier. Hence, although the material in the container may be a solid, further discussion of the examples will assume use of a liquid or gaseous material. The lamp 110 in the example includes a bulb 113. Although other materials could be used, the discussion below assumes that the bulb is glass. In some examples, there could be a separate container, in which case the bulb encloses the container. In the illustrated example, however, the glass of the bulb 113 serves as the container. The container wall(s) are transmissive with respect to at least a substantial portion of the visible light spectrum. For example, the glass of the bulb 113 will be thick enough (as represented by the wider lines), to provide ample strength to contain a liquid or gas material if used to bear the doped semiconductor nanophosphors in suspension, as shown at 115. However, the material of the bulb will allow transmissive entry of energy from the LEDs 111 to reach the nanophosphors in the material 115 and will allow transmissive output of visible light principally from the excited nanophosphors.

The glass bulb/container 113 receives energy from the LEDs 111 through a surface of the bulb, referred to here as an optical input coupling surface 113*c*. The example shows the surface 113*c* for the receiving portion of the container structure as a flat surface, although obviously outer contours may be used. Light output from the lamp 110 emerges through one or more other surfaces of the bulb 113, forming the output portion of the container structure, and here referred to as output surface 113*o*. As noted, in this example, the bulb 113 here is glass, although other appropriate transmissive materials may be used. For a diffuse outward appearance of the bulb, the output surface(s) 113*o* may be frosted white or translucent, although the optical input coupling surface 113*c* might still be transparent to reduce reflection of energy from the LEDs 111 back towards the LEDs. Alternatively, the output surface 113*o* may be transparent.

For some lighting applications where a single color is desirable rather than white, the lamp might use a single type of nanophosphor in the material. For a yellow 'bug lamp' type application, for example, the one nanophosphor would be of a type that produces yellow emission in response to pumping energy from the LEDs. For a red lamp type application, as another example, the one nanophosphor would be of a type that produces predominantly red light emission in response to pumping energy from the LEDs. The upper limits of the absorption spectra of the exemplary nanophosphors are all at or below 460 nm, therefore, the LEDs used in such a monochromatic lamp would emit energy in a wavelength range of 460 nm and below. In many examples, the lamp produces white light of desirable characteristics using a number of doped semiconductor nanophosphors, and further discussion of the lamp examples including that of FIG. 10 will concentrate on such white light implementations.

Hence for further discussion, we will assume that the container formed by the glass bulb 113 is at least substantially filled with a color-neutral transmissive (e.g. translucent or clear/transparent) liquid or gaseous material 115 bearing a number of different doped semiconductor nanophosphors dispersed in the liquid or gaseous material 115. Also, for further discussion, we will assume that the LEDs 111 are near UV emitting LEDs, such as 405 nm LEDs or other types of LEDs rated to emit somewhere in the wavelength range of 380-420 nm. Each of the doped semiconductor nanophosphors is of a type excited in response to near UV electromagnetic energy from the LEDs 111 of the solid state source. When so excited, each doped semiconductor nanophosphor re-emits visible light of a different spectrum. However, each such emission spectrum has substantially no overlap with absorption spectra of the doped semiconductor nanophosphors. When excited by the electromagnetic energy received from the LEDs 111, the doped semiconductor nanophosphors together produce visible light output for the lamp 110 through the exterior surface(s) of the glass bulb 113. As in the earlier examples, the liquid or gaseous material 115 with the doped semiconductor nanophosphors dispersed therein appears at least substantially color-neutral when the lamp 110 is off, that is to say it has little or no perceptible tint.

For lamp applications, it may be commercially desirable for a bulb to have a white outward appearance. If the bulb 113 is white along visible surfaces like output surface 113*o*, then the material 115 could be transparent or clear, although a translucent material could be used. If the bulb 113 is clear, then the material 115 could be translucent so that the product would appear white in the off-state. A clear bulb 113 and a clear material 115 could be used together, but in the off-state, a person could see the LEDs 111 from at least some directions.

The LEDs 111 are mounted on a circuit board 117. The exemplary lamp 110 also includes circuitry 119. Although drive from DC sources is contemplated for use in existing DC lighting systems, the examples discussed in detail utilize circuitry configured for driving the LEDs 111 in response to alternating current electricity, such as from the typical AC main lines. The circuitry may be on the same board 117 as the LEDs or disposed separately within the lamp 110 and electrically connected to the LEDs 111. Electrical connections of the circuitry 119 to the LEDs and the lamp base are omitted here for simplicity.

A housing 121 at least encloses the circuitry 119. In the example, the housing 121 together with a lamp base 123 and a face of the glass bulb 113 also enclose the LEDs 111. The lamp 110 has a lighting industry standard lamp base 123 mechanically connected to the housing and electrically connected to provide alternating current electricity to the circuitry 119 for driving the LEDs 111.

The lamp base 123 may be any common standard type of lamp base, to permit use of the lamp 110 in a particular type of lamp socket. Common examples include an Edison base, a mogul base, a candelabra base and a bi-pin base. The lamp base may have electrical connections for a single intensity setting or additional contacts in support of three-way intensity setting/dimming.

Figure 11:
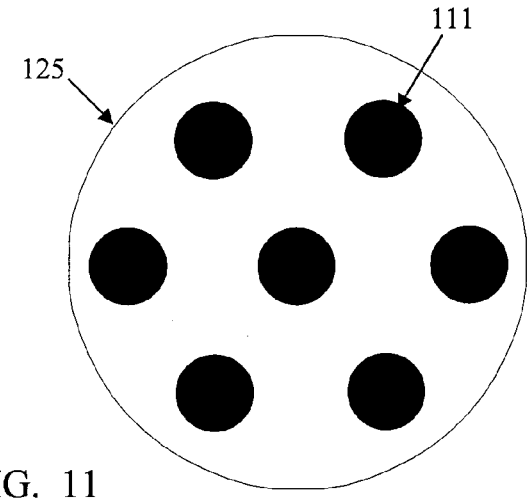
FIG. 11 is a plan view of the LEDs and reflector of the lamp of FIG. 10.

The exemplary lamp 110 of FIG. 10 may include one or more features intended to prompt optical efficiency. Hence, as illustrated, the lamp 110 includes a diffuse reflector 125. The circuit board 117 has a surface on which the LEDs 111 are mounted, so as to face toward the light receiving surface 113*c* of the glass bulb 113 containing the nanophosphor bearing material 115. The reflector 125 covers parts of that surface of the circuit board 117 in one or more regions between the LEDs 111. FIG. 11 is a view of the LEDs 111 and the reflector 125. When excited, the nanophosphors in the material 115 emit light in many different directions, and at least some of that light would be directed back toward the LEDs 111 and the circuit board 117. The diffuse reflector 125 helps to redirect much of that light back through the glass bulb 113 for inclusion in the output light distribution.

The lamp 110 may use one or any number of LEDs 111 sufficient to provide a desired output intensity. The example of FIG. 11 shows seven LEDs 111, although the lamp 110 may have more or less LEDs than in that example.

There may be some air gap between the emitter outputs of the LEDs 111 and the facing optical coupling surface 113*c* of the glass bulb container 113 (FIG. 10). However, to improve out-coupling of the energy from the LEDs 111 into the light transmissive glass of the bulb 113, it may be helpful to provide an optical grease, glue or gel 127 between the surface 113*c* of the glass bulb 113 and the optical outputs of the LEDs 111. This index matching material 127 eliminates any air gap and provides refractive index matching relative to the material of the glass bulb container 113.

The examples also encompass technologies to provide good heat conductivity so as to facilitate dissipation of heat generated during operation of the LEDs 111. Hence, the exemplary lamp 110 includes one or more elements forming a heat dissipater within the housing for receiving and dissipating heat produced by the LEDs 111. Active dissipation, passive dissipation or a combination thereof may be used. The lamp 110 of FIG. 10, for example, includes a thermal interface layer 131 abutting a surface of the circuit board 117, which conducts heat from the LEDs and the board to a heat sink arrangement 133 shown by way of example as a number of fins within the housing 121. The housing 121 also has one or more openings or air vents 135, for allowing passage of air through the housing 121, to dissipate heat from the fins of the heat sink 133.

The thermal interface layer 131, the heat sink 133 and the vents 135 are passive elements in that they do not consume additional power as part of their respective heat dissipation functions. However, the lamp 110 may include an active heat dissipation element that draws power to cool or otherwise dissipate heat generated by operations of the LEDs 111. Examples of active cooling elements include fans, Peltier devices or the like. The lamp 110 of FIG. 10 utilizes one or more membronic cooling elements. A membronic cooling element comprises a membrane that vibrates in response to electrical power to produce an airflow. An example of a membronic cooling element is a SynJet® sold by Nuventix. In the example of FIG. 10, the membronic cooling element 137 operates like a fan or air jet for circulating air across the heat sink 133 and through the air vents 135.

In the orientation illustrated in FIG. 10, white light from the semiconductor nanophosphor excitation is dispersed upwards and laterally, for example, for omni-directional lighting of a room from a table or floor lamp. The orientation shown, however, is purely illustrative. The lamp 110 may be oriented in any other direction appropriate for the desired lighting application, including downward, any sideways direction, various intermediate angles, etc.

In the example of FIG. 10, the glass bulb 113, containing the material 115 with the doped semiconductor nanophosphors produces a wide dispersion of output light, which is relatively omni-directional (except directly downward in the illustrated orientation). Such a light output intensity distribution corresponds to that currently offered by A-lamps. Other bulb/container structures, however, may be used; and a few examples include a globe-and-stem arrangement for A-Lamp type omni-directional lighting, as well as R-lamp and Par-lamp style bulbs for different directed lighting applications. At least for some of the directed lighting implementations, some internal surfaces of the bulbs may be reflective, to promote the desired output distributions. Tubular lamp implementations are also contemplated.

The lamp 110 of FIG. 10 has one of several industry standard lamp bases 123, shown in the illustration as a type of screw-in base. The glass bulb 113 exhibits a form factor within standard size, and the output distribution of light emitted via the bulb 113 conforms to industry accepted specifications, for a particular type of lamp product. Those skilled in the art will appreciate that these aspects of the lamp 110 facilitate use of the lamp as a replacement for existing lamps, such as incandescent lamps and compact fluorescent lamps. Tubular implementations might be used as replacements for fluorescent tubes.

The housing 121, the base 123 and components contained in the housing 121 can be combined with a bulb/container in one of a variety of different shapes. As such, these elements together may be described as a 'light engine' portion of the lamp for generating the near UV energy. Theoretically, the engine and bulb could be modular in design to allow a user to interchange glass bulbs, but in practice the lamp is an integral product. The light engine may be standardized across several different lamp product lines. In the example of FIG. 1, housing 121, the base 123 and components contained in the housing 121 could be the same for A-lamps, R-lamps, Par-lamps or other styles of lamps. A different base can be substituted for the screw base 123 shown in FIG. 10, to produce a lamp product configured for a different socket design.

As outlined above, the lamp 110 will include or have associated therewith remote semiconductor nanophosphors in a container that is external to the LEDs 111 of the solid state source. As such, the phosphors are located apart from the semiconductor chips of the LEDs 111 used in the particular lamp 110, that is to say remotely deployed.

The semiconductor nanophosphors are dispersed, e.g. in suspension, in a liquid or gaseous material 115, within a container (bulb 113 in the lamp 110 of FIG. 10). The liquid or gaseous medium preferably exhibits high transmissivity and/or low absorption to light of the relevant wavelengths and is color-neutral when the LEDs 111 are off, although for example it may be transparent or translucent.

In an example of a white light type lamp, the doped semiconductor nanophosphors in the material shown at 115 are of types or configurations (e.g. selected types of doped semiconductor nanophosphors) excitable by the near UV energy from LEDs 111 forming the solid state source. Together, the excited nanophosphors produce output light that is at least substantially white and has a color rendering index (CRI) of 75 or higher. The lamp output light produced by this near UV excitation of the semiconductor nanophosphors exhibits color temperature in one of several desired ranges along the black body curve. Different light lamps 110 designed for different color temperatures of white output light would use different formulations of mixtures of doped semiconductor nanophosphors. The white output light of the lamp 110 exhibits color temperature in one of four specific ranges along the black body curve, as in the earlier examples.

The lamps under consideration here may utilize a variety of different structural arrangements. In the example of FIG. 10, the glass bulb 113 also served as the container for the material 115 bearing the doped semiconductor nanophosphors. For some applications and/or manufacturing techniques, it may be desirable to utilize a separate container for the doped semiconductor nanophosphors and enclose the container within a bulb (glass or the like) that provides a particular form factor and outward light bulb appearance and light distribution.

The solid state sources in the various exemplary fixtures and lamps may be driven/controlled by a variety of different types of circuits. Depending on the type of LEDs selected for use in a particular lamp product design, the LEDs may be driven by AC current, typically rectified; or the LEDs may be driven by a DC current after rectification and regulation. The degree of control may be relatively simple, e.g. ON/OFF in response to a switch, or the circuitry may utilize a programmable digital controller, to offer a range of sophisticated options. Intermediate levels of sophistication of the circuitry and attendant control are also possible. Detailed examples of just a few different circuits that may be used to drive the LED type solid state sources in the examples above are described in more detail in the above-incorporated earlier applications.

The description and drawings have covered a number of examples of devices or systems that utilize an element that contains the nanophosphor bearing material. Those skilled in the art will recognize the lighting devices or systems may use two or more elements or containers for nanophosphor bearing material, wherein the nanophosphors are the same or different in the different containers.

The drawings and the discussion above have specifically addressed only a small number of examples of solid state lighting devices that may utilize the remote nanophosphor deployment technology and optical elements or other apparatuses for use in solid state lighting. Those skilled in the art will appreciate that the technology is readily adaptable to a wide range of other lighting devices and/or device components. By way of just a few more examples, attention may be directed to other fixture and lamp configurations disclosed in the above-incorporated earlier applications.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A lighting device, comprising:

a solid state source, containing at least one semiconductor chip within at least one package, for producing electromagnetic energy of a first emission spectrum;

an optical element outside the at least one package of the solid state source and separate from the at least semiconductor chip, arranged to receive electromagnetic energy of the first emission spectrum from the solid state source, the optical element including:

a semiconductor nanophosphor, wherein:

(a) the semiconductor nanophosphor has an absorption spectrum encompassing at least a substantial portion of the first emission spectrum, and (b) when excited by electromagnetic energy in the absorption spectrum from the solid state source, the semiconductor nanophosphor emits visible light in a second emission spectrum, for inclusion in a visible light output for the device;

(c) a light transmissive container; and a material bearing the semiconductor nanophosphor within the container, wherein:

(i) the material is transmissive, at least with respect to energy of the first and second emission spectra, (ii) the material with the semiconductor nanophosphor dispersed therein appears at least substantially color-neutral when the solid state source is off, and (iii) the material is a gas or liquid filling an interior volume of a container.

2. The lighting device of claim 1, further comprising a different semiconductor nanophosphor dispersed in the material, wherein:

the different semiconductor nanophosphor has an absorption spectrum encompassing at least a substantial portion of the first emission spectrum, when excited by electromagnetic energy in the absorption spectrum of the different semiconductor nanophosphor, from the solid state source, the different semiconductor nanophosphor emits visible light in a third emission spectrum that is different from the second emission spectrum, for inclusion in the visible light output from the device, the second and third emission spectra are separated from the absorption spectra of the nanophosphors, the material with the semiconductor nanophosphors dispersed therein appears at least substantially color-neutral when the solid state source is off, the visible light output from the device produced by excitation of the semiconductor nanophosphors is at least substantially white, the visible light output from the device produced by the excitation of the semiconductor nanophosphors has a color rendering index (CRI) of 75 or higher, and the visible light output from the device produced by the excitation of the semiconductor nanophosphors has a color temperature in one of the following ranges:

2,725±145° Kelvin;

3,045±175° Kelvin;

3,465±245° Kelvin; and 3,985±275° Kelvin.

3. The lighting device of claim 1, wherein:

the solid state source comprises one or more light emitting diodes, each light emitting diode is rated for producing electromagnetic energy of a wavelength in the range of 460 nm and below, and the absorption spectrum of the semiconductor nanophosphor has an upper limit at approximately 460 nm or below.

4. The light emitting device of claim 1, wherein the device is configured as a light fixture for a general lighting application to supply illumination in an area intended to be inhabited by a person, the light fixture further comprising a power source.

5. The light emitting device of claim 1, wherein the device is configured as a lamp, the lamp further comprising a bulb.

6. The light emitting device of claim 1, wherein the material bearing the semiconductor nanophosphor appears at least substantially clear when the when the solid state source is off.

7. The light emitting device of claim 1, wherein the material bearing the semiconductor nanophosphor appears at least substantially translucent when the solid state source is off.

8. The lighting device of claim 1, wherein the semiconductor nanophosphor comprises a doped semiconductor nanophosphor.

9. The lighting device of claim 8, wherein:

the material bearing the doped semiconductor nanophosphor is a liquid at least substantially filling the interior volume of the container, and the lighting device further comprises a bubble in the interior volume of the container with the liquid, the bubble being configured to essentially disappear when the liquid material bearing the semiconductor nanophosphor reaches a nominal operating temperature.

10. The lighting device of claim 8, wherein:

the material bearing the doped semiconductor nanophosphor is a liquid at least substantially filling the interior volume of the container, and at least a portion of the light transmissive container through which excitation light from the doped semiconductor nanophosphor emerges for an output from the lighting device is at least substantially transparent with respect to visible light.

11. The lighting device of claim 8, wherein:

the material bearing the doped semiconductor nanophosphor is a liquid at least substantially filling the interior volume of the container, and at least a portion of the light transmissive container through which excitation light from the doped semiconductor nanophosphor emerges for an output from the lighting device is translucent.

12. The lighting device of claim 8, wherein:

the material bearing the doped semiconductor nanophosphor is a gas contained in the interior volume of the container, and the gas comprises one gas or a combination of gases each selected from the group consisting of: hydrogen gas, inert gases and hydrocarbon based gases.

13. The lighting device of claim 12, wherein at least a portion of the light transmissive container through which excitation light from the doped semiconductor nanophosphor emerges for an output from the lighting device is at least substantially transparent with respect to energy of the first emission spectrum.

14. The lighting device of claim 12, wherein at least a portion of the light transmissive container through which excitation light from the doped semiconductor nanophosphor emerges for an output from the lighting device is translucent.

15. A lighting device, comprising:

a solid state source, containing at least one semiconductor chip within at least one package, for producing electromagnetic energy of a first emission spectrum;

an optical element outside the at least one package of the solid state source and separate from the at least semiconductor chip, arranged to receive electromagnetic energy of the first emission spectrum from the solid state source, the optical element including:

a semiconductor nanophosphor, wherein:

(a) the semiconductor nanophosphor has an absorption spectrum encompassing at least a substantial portion of the first emission spectrum, and (b) when excited by electromagnetic energy in the absorption spectrum from the solid state source, the semiconductor nanophosphor emits visible light in a second emission spectrum, for inclusion in a visible light output for the device;

(c) a light transmissive container; and a material bearing the semiconductor nanophosphor within the container, wherein:

(i) the material is transmissive, at least with respect to energy of the first and second emission spectra, and (ii) the material with the semiconductor nanophosphor dispersed therein appears at least substantially color-neutral when the solid state source is off, wherein the material bearing the semiconductor nanophosphor is a solid, wherein:

the solid completely fills an interior volume of a container, or the solid comprises a silicon included throughout an interior volume of the container.

16. The lighting device of claim 15, further comprising a different semiconductor nanophosphor dispersed in the material, wherein:

the different semiconductor nanophosphor has an absorption spectrum encompassing at least a substantial portion of the first emission spectrum, when excited by electromagnetic energy in the absorption spectrum of the different semiconductor nanophosphor, from the solid state source, the different semiconductor nanophosphor emits visible light in a third emission spectrum that is different from the second emission spectrum, for inclusion in the visible light output from the device, the second and third emission spectra are separated from the absorption spectra of the nanophosphors, the material with the semiconductor nanophosphors dispersed therein appears at least substantially color-neutral when the solid state source is off, the visible light output from the device produced by excitation of the semiconductor nanophosphors is at least substantially white, the visible light output from the device produced by the excitation of the semiconductor nanophosphors has a color rendering index (CRI) of 75 or higher, and the visible light output from the device produced by the excitation of the semiconductor nanophosphors has a color temperature in one of the following ranges:

2,725±145° Kelvin;

3,045±175° Kelvin;

3,465±245° Kelvin; and 3,985±275° Kelvin.

17. The lighting device of claim 15, wherein:

the solid state source comprises one or more light emitting diodes, each light emitting diode is rated for producing electromagnetic energy of a wavelength in the range of 460 nm and below, and the absorption spectrum of the semiconductor nanophosphor has an upper limit at approximately 460 nm or below.

18. A lighting device, comprising:

a solid state source, containing at least one semiconductor chip within at least one package, for producing electromagnetic energy of a first emission spectrum;

an optical element outside the at least one package of the solid state source and separate from the at least semiconductor chip, arranged to receive electromagnetic energy of the first emission spectrum from the solid state source, the optical element including:

a semiconductor nanophosphor, wherein:

(a) the semiconductor nanophosphor has an absorption spectrum encompassing at least a substantial portion of the first emission spectrum, and (b) when excited by electromagnetic energy in the absorption spectrum from the solid state source, the semiconductor nanophosphor emits visible light in a second emission spectrum, for inclusion in a visible light output for the device; and a material bearing the semiconductor nanophosphor, wherein:

(i) the material is transmissive, at least with respect to energy of the first and second emission spectra, and (ii) the material with the semiconductor nanophosphor dispersed therein appears at least substantially color-neutral when the solid state source is off, wherein the semiconductor nanophosphor comprises a quantum dot phosphor, the optical element further includes a light transmissive container, and the material bearing the quantum dot phosphor is a liquid at least substantially filling an interior volume of the container.

19. The lighting device of claim 18, further comprising a different semiconductor nanophosphor dispersed in the material, wherein:

the different semiconductor nanophosphor has an absorption spectrum encompassing at least a substantial portion of the first emission spectrum, when excited by electromagnetic energy in the absorption spectrum of the different semiconductor nanophosphor, from the solid state source, the different semiconductor nanophosphor emits visible light in a third emission spectrum that is different from the second emission spectrum, for inclusion in the visible light output from the device, the second and third emission spectra are separated from the absorption spectra of the nanophosphors, the material with the semiconductor nanophosphors dispersed therein appears at least substantially color-neutral when the solid state source is off, the visible light output from the device produced by excitation of the semiconductor nanophosphors is at least substantially white, the visible light output from the device produced by the excitation of the semiconductor nanophosphors has a color rendering index (CRI) of 75 or higher, and the visible light output from the device produced by the excitation of the semiconductor nanophosphors has a color temperature in one of the following ranges:
2,725±145° Kelvin;
3,045±175° Kelvin;
3,465±245° Kelvin; and
3,985±275° Kelvin.

20. The lighting device of claim 18, wherein:

the solid state source comprises one or more light emitting diodes, each light emitting diode is rated for producing electromagnetic energy of a wavelength in the range of 460 nm and below, and the absorption spectrum of the semiconductor nanophosphor has an upper limit at approximately 460 nm or below.

* * * * *